US007394903B2

(12) United States Patent
Herre et al.

(10) Patent No.: US 7,394,903 B2
(45) Date of Patent: Jul. 1, 2008

(54) APPARATUS AND METHOD FOR CONSTRUCTING A MULTI-CHANNEL OUTPUT SIGNAL OR FOR GENERATING A DOWNMIX SIGNAL

(75) Inventors: Jürgen Herre, Buckhof (DE); Christof Faller, Trägerwilen (CH)

(73) Assignee: Fraunhofer-Gesellschaft zur Forderung der Angewandten Forschung E.V., Munich (DE)

( * ) Notice: Subject to any disclaimer, the term of this patent is extended or adjusted under 35 U.S.C. 154(b) by 847 days.

(21) Appl. No.: 10/762,100

(22) Filed: Jan. 20, 2004

(65) Prior Publication Data

US 2005/0157883 A1 Jul. 21, 2005

(51) Int. Cl.
*H04R 5/00* (2006.01)

(52) U.S. Cl. ..... 381/23; 381/17; 381/18; 381/19; 700/94; 704/500; 704/501

(58) Field of Classification Search ..... 381/17–23, 381/1; 704/203, 205, 500–501; 700/94
See application file for complete search history.

(56) References Cited

U.S. PATENT DOCUMENTS

| | | | | |
|---|---|---|---|---|
| 5,701,346 | A * | 12/1997 | Herre et al. | 381/18 |
| 5,912,976 | A | 6/1999 | Klayman et al. | |
| 6,763,115 | B1 | 7/2004 | Kobayashi | |
| 7,006,636 | B2 * | 2/2006 | Baumgarte et al. | 381/17 |
| 7,292,901 | B2 * | 11/2007 | Baumgarte et al. | 700/94 |
| 2001/0014160 | A1 * | 8/2001 | Maejima | 381/23 |
| 2002/0067834 | A1 * | 6/2002 | Shirayanagi | 381/20 |
| 2003/0026441 | A1 | 2/2003 | Faller | |

(Continued)

FOREIGN PATENT DOCUMENTS

EP 1 376 538 A1 1/2004

(Continued)

OTHER PUBLICATIONS

Erik Schuijers et al.: "Low complexity parametric stereo coding", *Audio Engineering Society, Convention Paper 6073, 116th Convention*, May 8-11, 2004, Berlin, Germany, pp. 1-11.

(Continued)

*Primary Examiner*—Vivian Chin
*Assistant Examiner*—Disler Paul
(74) *Attorney, Agent, or Firm*—Laurence A. Greenberg; Werner H. Stemer; Ralph E. Locher

(57) ABSTRACT

The apparatus for constructing a multi-channel output signal using an input signal and parametric side information, the input signal including the first input channel and the second input channel derived from an original multi-channel signal, and the parametric side information describing interrelations between channels of the multi-channel original signal uses base channels for synthesizing first and second output channels on one side of an assumed listener position, which are different from each other. The base channels are different from each other because of a coherence measure. Coherence between the base channels (for example the left and the left surround reconstructed channel) is reduced by calculating a base channel for one of those channels by a combination of the input channels, the combination being determined by the coherence measure. Thus, a high subjective quality of the reconstruction can be obtained because of an approximated original front/back coherence.

26 Claims, 15 Drawing Sheets

U.S. PATENT DOCUMENTS

| | | | | |
|---|---|---|---|---|
| 2003/0035553 | A1 | 2/2003 | Baumgarte et al. | |
| 2003/0210794 | A1* | 11/2003 | Sato et al. | 381/22 |
| 2003/0219130 | A1 | 11/2003 | Baumgarte et al. | |
| 2003/0236583 | A1* | 12/2003 | Baumgarte et al. | 700/94 |
| 2005/0053242 | A1* | 3/2005 | Henn et al. | 381/22 |

FOREIGN PATENT DOCUMENTS

WO 03/090207 A1 10/2003

OTHER PUBLICATIONS

Christof Faller: "Coding of Spatial Audio Compatible with Different Playback Formats", *Audio Engineering Society, Convention Paper, 117th Convention*, Oct. 28-31, 2004, San Francisco, CA, pp. 1-12.

Christof Faller et al.: "Binaural Cue Coding—Part II: Schemes and Applications", *IEEE Transactions on Speech and Audio Processing*, vol. 11, No. 6, Nov. 2003, pp. 520-531.

Jürgen Herre et al.: "Intensity Stereo Coding", *AES 96th Convention*, Feb. 26-Mar. 1, 1994, Amsterdam, Netherlands, AES preprint 3799, pp. 1-10.

Christof Faller et al.: "Binaural Cue Coding Applied to Stereo and Multi-Channel Audio Compression", *Audio Engineering Society, Convention Paper 5574, 112th Convention*, May 10-13, 2002, Munich, Germany, pp. 1-9.

Christof Faller et al.: "Binaural Cue Coding. Part II: Schemes and Applications", *IEEE Transactions on Speech and Audio Processing*", vol. XX, No. Y, Month 2002, pp. 1-12.

Günther Theile et al.: "Musicam-Surround: A Universal Multi-Channel Coding System Compatible with ISO 11172-3", *Audio Engineering Society, Convention Paper 3403, 93rd Convention*, Oct. 1-4, 1992, San Francisco, CA, pp. 1-9.

B. Grill et al.: "Improved MPEG-2 Audio-Channel Encoding", *Audio Engineering Society, Convention Paper 3865, 96th Convention*, Feb. 26-Mar. 1, 1994, Amsterdam, Netherlands, pp. 1-9.

Frank Baumgarte et al.: "Binaural Cue Coding—Part I: Psychoacoustic Fundamentals and Design Principles", *IEEE Transactions on Speech and Audio processing*, vol. 11, No. 6, Nov. 2003, pp. 509-519.

Joseph Hull: "Surround Sound Past, Present, and Future", *Dolby Laboratories*, 1999, pp. 1-7.

Roger Dressler: "Dolby Surround Pro Logic II Decoder Principles of Operation", *Dolby Laboratories, Inc.*, 2000, pp. 1-7.

Jürgen Herre et al.: "Combined Stereo Coding", *Audio Engineering Society, Convention Paper 3369, 96th Convention*, Oct. 1-4, 1992, San Francisco, pp. 1-17.

Dolby Laboratories, Inc. User's Manual: "Dolby DP563 Dolby Surround and Pro Logic II Encoder", Issue 3, 2003.

Juergen Herre et al.: "MP3 Surround: Efficient and Compatible Coding of Multi-Channel Audio", *Audio Engineering Society, Convention Paper 6049, 116th Convention*, May 8-11, 2004, Berlin, Germany, pp. 1-14.

* cited by examiner

FIG 1A (Encoder)
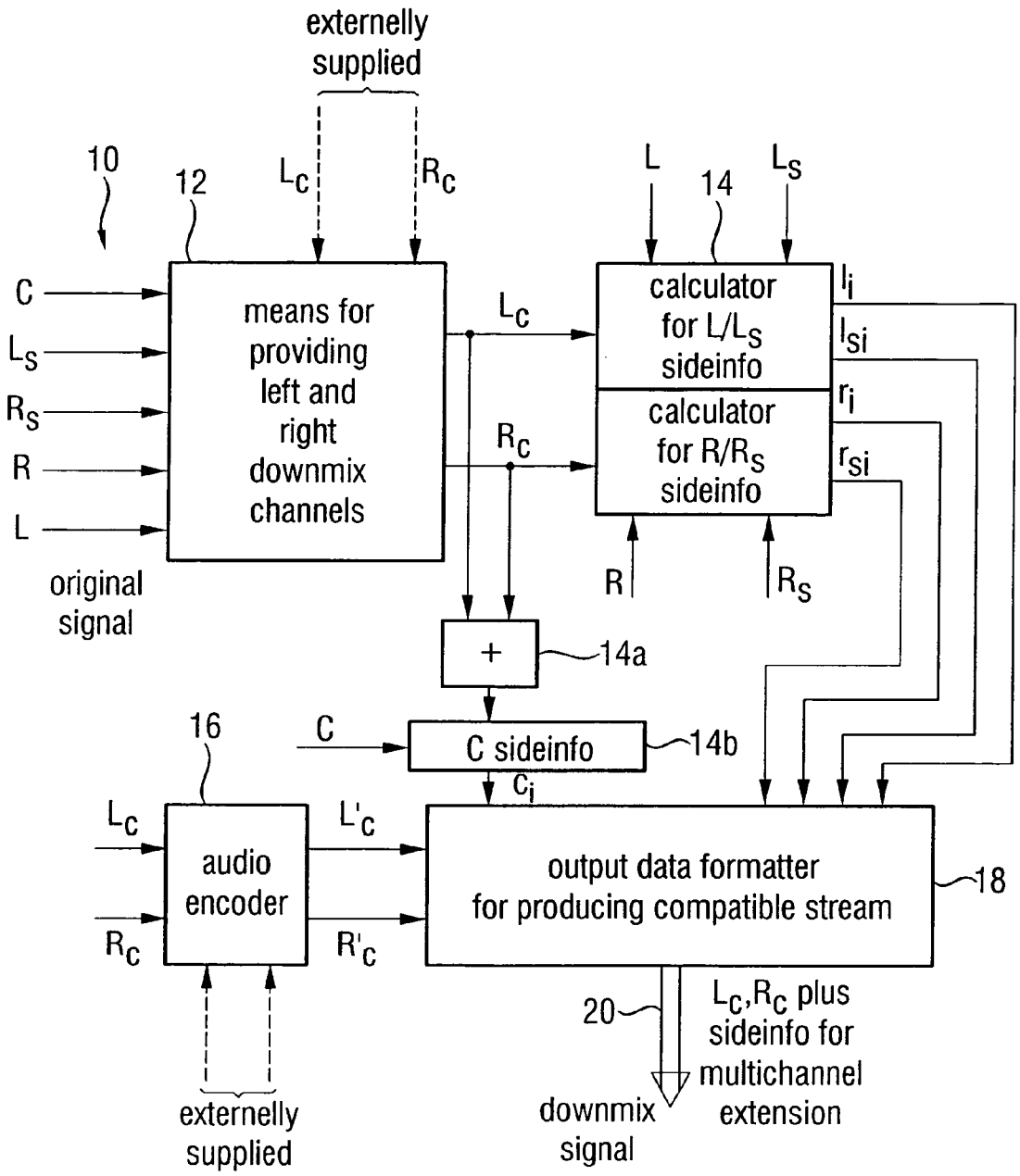

FIG 2A (Decoder)
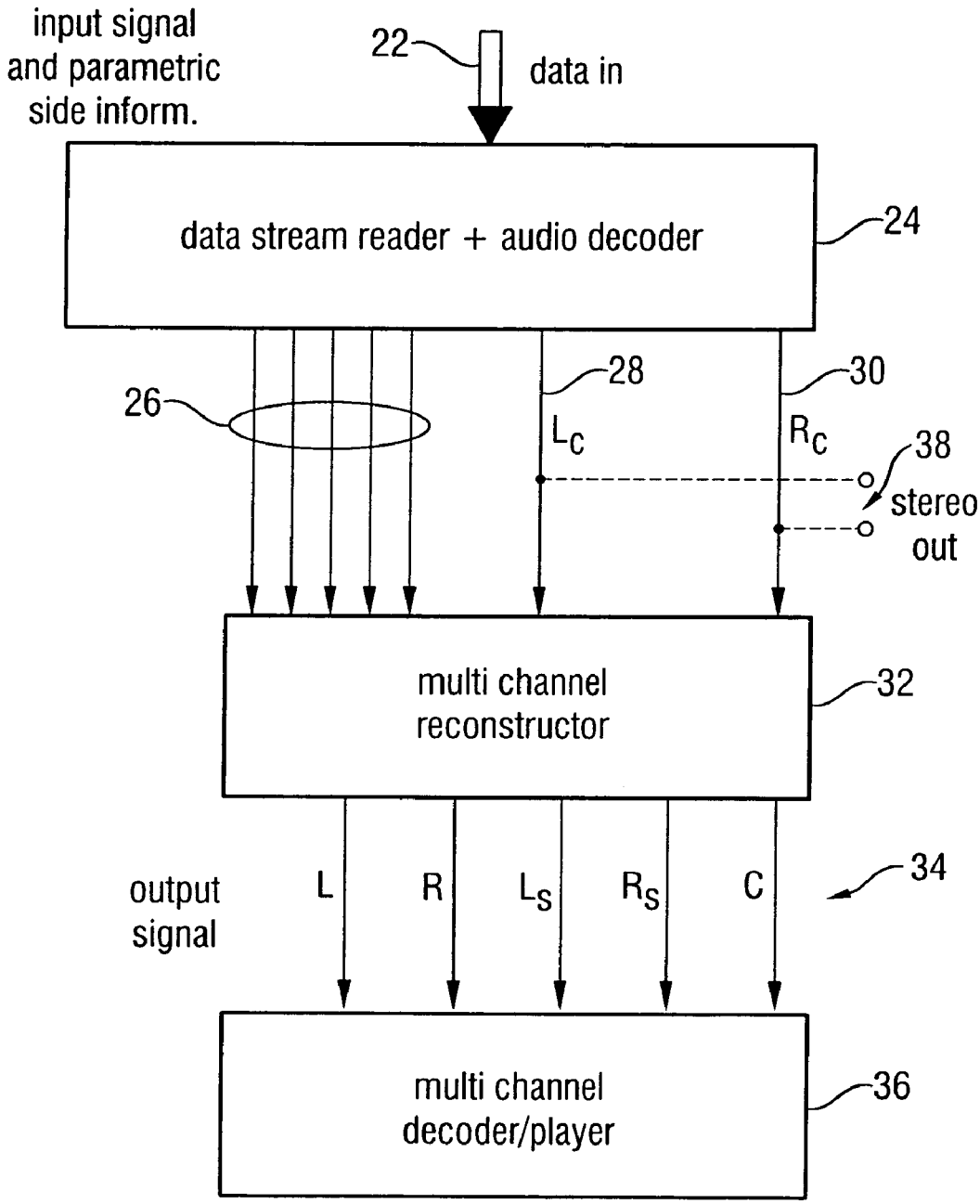

FIG 2E (encoder side)

means for determining coherence measure $$cc(x,y)=\frac{\Sigma x_i \cdot y_i}{\sqrt{\sum_i x_i^2} \cdot \sqrt{\sum_i y_i^2}}$$

cc: coherence measure (cross correlation)

$x_i$: sample at time instance i of first original channel $y_i$: sample at time instance i of 2nd original channel

FIG 2F (decoder side)

base channel for left (L) output channel: $l \triangleq L_c$ base channel for rear left (Ls) output ch.: $l+\alpha \cdot r \triangleq L_c+\alpha \cdot R_c$ $$k=cc(l,l+\alpha \cdot r)$$

$$\frac{\Sigma l \cdot [l+\alpha \cdot r]}{\sqrt{\Sigma l^2} \cdot \sqrt{\Sigma [l+\alpha \cdot r]^2}}=k$$

$$-1 \leq k \leq 1$$

$\alpha$: weighting factor (to be determined)

l: left input channel r: right input channel k: coherence measure (time-varyring, transmitted as side information)

$$\alpha_{1;2}=\frac{-B \pm \sqrt{B^2-4AC}}{2A}$$

wherein: $L=\Sigma l^2$ $R=\Sigma r^2$ $C=\Sigma l \cdot r$ ; and $$A=C^2-k^2LR \quad B=2LC(1-k^2) \quad C=L^2(1-k^2).$$

FIG 4 (encoder side)
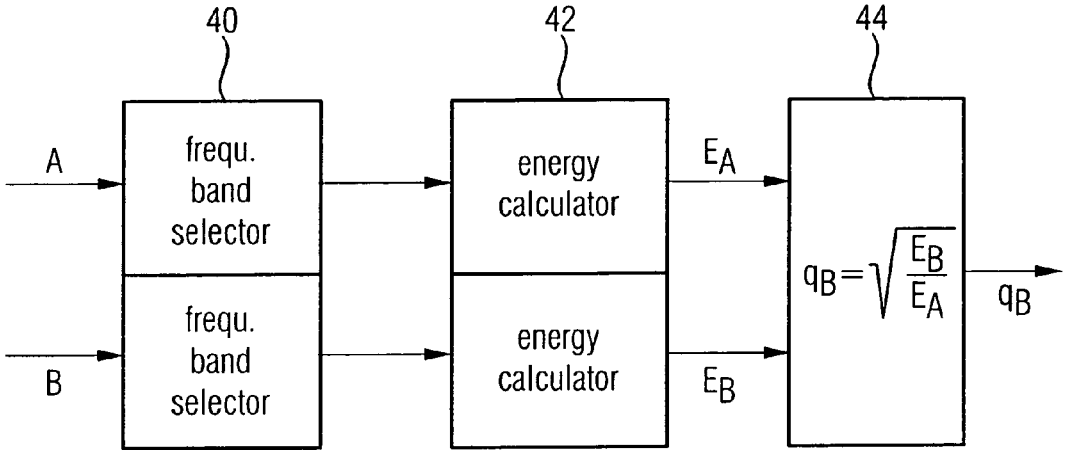
FIG 5 (decoder side)
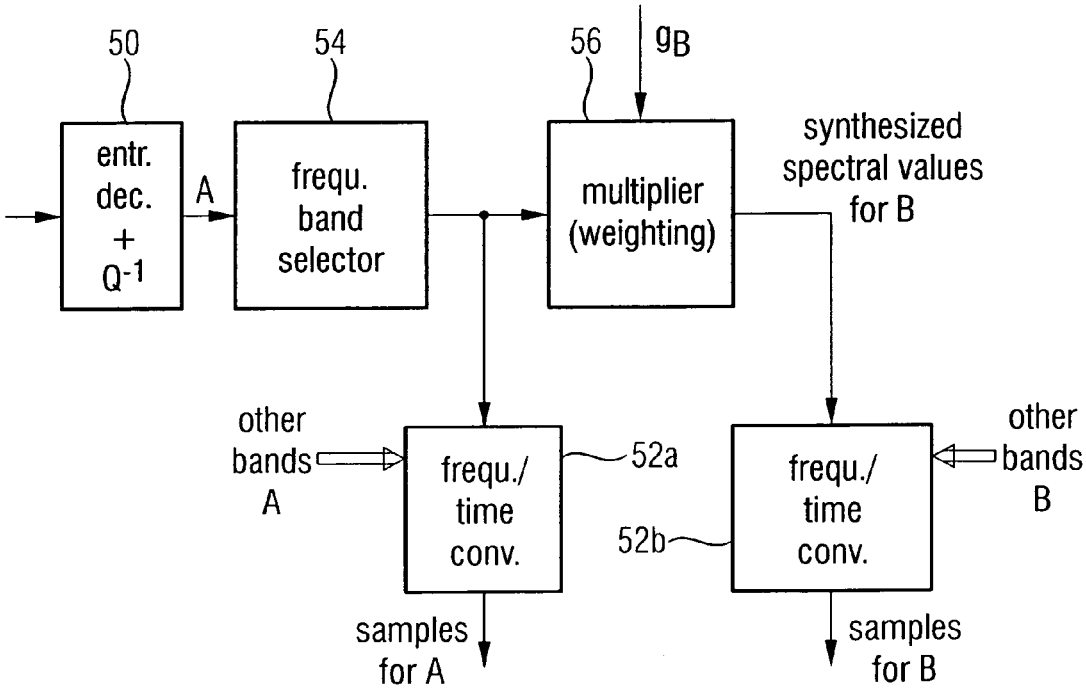

FIG 6

DOWNMIX

| |
|---|
| $L_C = t \cdot [L + a \cdot L_S + b \cdot C]$ |
| $R_C = t \cdot [R + a \cdot R_S + b \cdot C]$ |

all signals are time domain signals $a, b, t \leq 1$
preferred: $a = b = 0{,}7$
or: $a = 0{,}5$ ; $b = 0{,}7$

FIG 7 ch. side info

CHANNEL B

CHANNEL A

| | side infos/parameters for: | are determined using: |
|---|---|---|
| $l_i$ | $L$ | $L_C$ |
| $l_{si}$ | $L_S$ | $L_C$ |
| $r_i$ | $R$ | $R_C$ |
| $r_{si}$ | $R_S$ | $R_C$ |
| $c_i$ | $C$ | $L_C + R_C$ |

Base channels:
left=L
right=R
center=L+R
rear left=L+0.7R
rear right=R+0.7L most independence between front left and front right Base channels:
left=L
right=R+0.7L
center=L+R
rear left=L+0.7R
rear right=R most independence between left and rear right

APPARATUS AND METHOD FOR CONSTRUCTING A MULTI-CHANNEL OUTPUT SIGNAL OR FOR GENERATING A DOWNMIX SIGNAL

FIELD OF THE INVENTION

The present invention relates to an apparatus and a method for processing a multi-channel audio signal and, in particular, to an apparatus and a method for processing a multi-channel audio signal in a stereo-compatible manner.

BACKGROUND OF THE INVENTION AND PRIOR ART

In recent times, the multi-channel audio reproduction technique is becoming more and more important. This may be due to the fact that audio compression/encoding techniques such as the well-known mp3 technique have made it possible to distribute audio records via the Internet or other transmission channels having a limited bandwidth. The mp3 coding technique has become so famous because of the fact that it allows distribution of all the records in a stereo format, i.e., a digital representation of the audio record including a first or left stereo channel and a second or right stereo channel.

Nevertheless, there are basic shortcomings of conventional two-channel sound systems. Therefore, the surround technique has been developed. A recommended multi-channel-surround representation includes, in addition to the two stereo channels L and R, an additional center channel C and two surround channels Ls, Rs. This reference sound format is also referred to as three/two-stereo, which means three front channels and two surround channels. Generally, five transmission channels are required. In a playback environment, at least five speakers at the respective five different places are needed to get an optimum sweet spot in a certain distance from the five well-placed loudspeakers.

Several techniques are known in the art for reducing the amount of data required for transmission of a multi-channel audio signal. Such techniques are called joint stereo techniques. To this end, reference is made to FIG. 10, which shows a joint stereo device 60. This device can be a device implementing e.g. intensity stereo (IS) or binaural cue coding (ECC). Such a device generally receives—as an input—at least two channels (CH1, CH2, . . . CHn), and outputs a single carrier channel and parametric data. The parametric data are defined such that, in a decoder, an approximation of an original channel (CH1, CH2, . . . CHn) can be calculated.

Normally, the carrier channel will include subband samples, spectral coefficients, time domain samples etc, which provide a comparatively fine representation of the underlying signal, while the parametric data do not include such samples of spectral coefficients but include control parameters for controlling a certain reconstruction algorithm such as weighting by multiplication, time shifting, frequency shifting, . . . The parametric data, therefore, include only a comparatively coarse representation of the signal or the associated channel. Stated in numbers, the amount of data required by a carrier channel will be in the range of 60-70 kbit/s, while the amount of data required by parametric side information for one channel will be in the range of 1.5-2.5 kbit/s. An example for parametric data are the well-known scale factors, intensity stereo information or binaural cue parameters as will be described below.

Intensity stereo coding is described in AES preprint 3799, "Intensity Stereo Coding", J. Herre, K. H. Brandenburg, D. Lederer, February 1994, Amsterdam. Generally, the concept of intensity stereo is based on a main axis transform to be applied to the data of both stereophonic audio channels. If most or the data points are concentrated around the first principle axis, a coding gain can be achieved by rotating both signals by a certain angle prior to coding. This is, however, not always true for real stereophonic production techniques. Therefore, this technique is modified by excluding the second orthogonal component from transmission in the bit stream. Thus, the reconstructed signals for the left and right channels consist of differently weighted or scaled versions of the same transmitted signal. Nevertheless, the reconstructed signals differ in their amplitude but are identical regarding their phase information. The energy-time envelopes of both original audio channels, however, are preserved by means of the selective scaling operation, which typically operates in a frequency selective manner. This conforms to the human perception of sound at high frequencies, where the dominant spatial cues are determined by the energy envelopes.

Additionally, in practically implementations, the transmitted signal, i.e. the carrier channel is generated from the sum signal of the left channel and the right channel instead of rotating both components. Furthermore, this processing, i.e., generating intensity stereo parameters for performing the scaling operation, is performed frequency selective, i.e., independently for each scale factor band, i.e., encoder frequency partition. Preferably, both channels are combined to form a combined or "carrier" channel, and, in addition to the combined channel, the intensity stereo information is determined which depend on the energy of the first channel, the energy of the second channel or the energy of the combined or channel.

The BCC technique is described in AES convention paper 5574, "Binaural cue coding applied to stereo and multi-channel audio compression", C. taller, F. Baumgarte, May 2002, Munich. In BCC encoding, a number of audio input channels are converted to a spectral representation using a DFT based transform with overlapping windows. The resulting uniform spectrum is divided into non-overlapping partitions each having an index. Each partition has a bandwidth proportional to the equivalent rectangular bandwidth (ERB). The inter-channel level differences (ICLD) and the inter-channel time differences (ICTD) are estimated for each partition for each frame k. The ICLD and ICTD are quantized and coded resulting in a BCC bit stream. The inter-channel level differences and inter-channel time differences are given for each channel relative to a reference channel. Then, the parameters are calculated in accordance with prescribed formulae, which depend on the certain partitions of the signal to be processed.

At a decoder-side, the decoder receives a mono signal and the BCC bit stream. The mono signal is transformed into the frequency domain and input into a spatial synthesis block, which also receives decoded ICLD and ICTD values. In the spatial synthesis block, the BCC parameters (ICLD and ICTD) values are used to perform a weighting operation of the mono signal in order to synthesize the multi-channel signals, which, after a frequency/time conversion, represent a reconstruction of the original multi-channel audio signal.

In case of BCC, the joint stereo module 60 is operative to output the channel side information such that the parametric channel data are quantized and encoded ICLD or ICTD parameters, wherein one of the original channels is used as the reference channel for coding the channel side information.

Normally, the carrier channel is formed of the sum of the participating original channels.

Naturally, the above techniques only provide a mono representation for a decoder, which can only process the carrier channel, but is not able to process the parametric data for generating one or more approximations of more than one input channel.

The audio coding technique known as binaural cue coding (BCC) is also well described in the U.S. patent application publications US 2003, 0219130 A1, 2003/0026441 A1 and 2003/0035553 A1. Additional reference is also made to "Binaural Cue Coding. Part II: Schemes and Applications", C. Faller and F. Baumgarte, IEEE Trans. On Audio and Speech Proc., Vol. 11, No. 6, November 2993. The cited U.S. patent application publications and the two cited technical publications on the BCC technique authored by Faller and Baumgarte are incorporated herein by reference in their entireties.

In the following, a typical generic BCC scheme for multi-channel audio coding is elaborated in more detail with reference to FIGS. 11 to 13. FIG. 11 shows such a generic binaural cue coding scheme for coding/transmission of multi-channel audio signals. The multi-channel audio input signal at an input 110 of a BCC encoder 112 is downmixed in a downmix block 114. In the present example, the original multi-channel signal at the input 110 is a 5-channel surround signal having a front left channel, a front right channel, a left surround channel, a right surround channel and a center channel. In a preferred embodiment of the present invention, the downmix block 114 produces a sum signal by a simple addition of these five channels into a mono signal. Other downmixing schemes are known in the art such that, using a multi-channel input signal, a downmix signal having a single channel can be obtained. This single channel is output at a sum signal line 115. A side information obtained by a BCC analysis block 116 is output at a side information line 117. In the BCC analysis block, inter-channel level differences (ICLD), and inter-channel time differences (ICTD) are calculated as has been outlined above. Recently, the BCC analysis block 116 has been enhanced to also calculate inter-channel correlation values (ICC values). The sum signal and the side information is transmitted, preferably in a quantized and encoded form, to a BCC decoder 120. The BCC decoder decomposes the transmitted sum signal into a number of subbands and applies scaling, delays and other processing to generate the subbands of the output multi-channel audio signals. This processing is performed such that ICLD, ICTD and ICC parameters (cues) of a reconstructed multi-channel signal at an output 121 are similar to the respective cues for the original multi-channel signal at the input 110 into the BCC encoder 112. To this end, the BCC decoder 120 includes a BCC synthesis block 122 and a side information processing block 123.

In the following, the internal construction of the BCC synthesis block 122 is explained with reference to FIG. 12. The sum signal on line 115 is input into a time/frequency conversion unit or filter bank FB 125. At the output of block 125, there exists a number N of sub band signals or, in an extreme case, a block of a spectral coefficients, when the audio filter bank 125 performs a 1:1 transform, i.e., a transform which produces N spectral coefficients from N time domain samples.

The BCC synthesis block 122 further comprises a delay stage 126, a level modification stage 127, a correlation processing stage 128 and an inverse filter bank stage IFB 129. At the output of stage 129, the reconstructed multi-channel audio signal having for example five channels in case of a 5-channel surround system, can be output to a set of loud-speakers 124 as illustrated in FIG. 11.

As shown in FIG. 12, the input signal s(n) is converted into the frequency domain or filter bank domain by means of element 125. The signal output by element 125 is multiplied such that several versions of the same signal are obtained as illustrated by multiplication node 130. The number of versions of the original signal is equal to the number of output channels in the output signal to be reconstructed When, in general, each version of the original signal at node 130 is subjected to a certain delay $d_1, d_2, \ldots, d_i, \ldots, d_N$. The delay parameters are computed by the side information processing block 123 in FIG. 11 and are derived from the inter-channel time differences as determined by the BCC analysis block 116.

The same is true for the multiplication parameters $a_1, a_2, \ldots, a_i, \ldots, a_N$, which are also calculated by the side information processing block 123 based on the inter-channel level differences as calculated by the BCC analysis block 116.

The ICC parameters calculated by the BCC analysis block 116 are used for controlling the functionality of block 128 such that certain correlations between the delayed and level-manipulated signals are obtained at the outputs of block 128. It is to be noted here that the ordering of the stages 126, 127, 128 may be different from the case shown in FIG. 12.

It is to be noted here that, in a frame-wise processing of an audio signal, the SCC analysis is performed frame-wise, i.e. time-varying, and also frequency-wise. This means that, for each spectral band, the BCC parameters are obtained. This means that, in case the audio filter bank 125 decomposes the input signal into for example 32 band pass signals, the BCC analysis block obtains a set of BCC parameters for each of the 32 bands. Naturally the BCC synthesis block 122 from FIG. 11, which is shown in detail in FIG. 12, performs a reconstruction which is also based on the 32 bands in the example.

In the following, reference is made to FIG. 13 showing a setup to determine certain BCC parameters. Normally, ICLD, ICTD and ICC parameters can be defined between pairs of channels. However, it is preferred to determine ICLD and ICTD parameters between a reference channel and each other channel. This is illustrated in FIG. 13A. ICC parameters can be defined in different ways. Most generally, one could estimate ICC parameters in the encoder between all possible channel pairs as indicated in FIG. 13B. In this case, a decoder would synthesize ICC such that it is approximately the same as in the original multi-channel signal between all possible channel pairs. It was, however, proposed to estimate only ICC parameters between the strongest two channels at each time. This scheme is illustrated in FIG. 13C, where an example is shown, in which at one time instance, an ICC parameter is estimated between channels 1 and 2, and, at another time instance, an ICC parameter is calculated between channels 1 and 5. The decoder then synthesizes the inter-channel correlation between the strongest channels in the decoder and applies some heuristic rule for computing and synthesizing the inter-channel coherence for the remaining channel pairs.

Regarding the calculation of, for example, the multiplication parameters $a_1, a_N$ based on transmitted ICLD parameters, reference is made to AES convention paper 5574 cited above. The ICLD parameters represent an energy distribution in an original multi-channel signal. Without loss of generality, it is shown in FIG. 13A that there are four ICLD parameters showing the energy difference between all other channels and the front left channel. In the side information processing block 123, the multiplication parameters $a_1, \ldots, a_N$ are derived from the ICLD parameters such chat the total energy of all reconstructed output channels is the same as (or proportional to) the energy of the transmitted sum signal. A simple way for determining these parameters is a 2-stage process, in which, in a first stage, the multiplication factor for the left front channel is set to unity, while multiplication factors for the other channels in FIG. 13A are set to the transmitted ICLD values. Then, in a second stage, the energy of all five channels is calculated and compared to the energy of the transmitted sum signal. Then, all channels are downscaled using a downscaling factor which is equal for all channels, wherein the downscaling factor is selected such that the total energy of all reconstructed output channels is, after downscaling, equal to the total energy of the transmitted sum signal.

Naturally, there are other methods for calculating the multiplication factors, which do not rely on the 2-stage process but which only need a 1-stage process.

Regarding the delay parameters, it is to be noted that the delay parameters ICTD, which are transmitted from a BCC encoder can be used directly, when the delay parameter d, for the left front channel is set to zero. No resealing has to be done here, since a delay does not alter the energy of the signal.

Regarding the inter-channel coherence measure ICC transmitted from the BCC encoder to the BCC decoder, it is to be noted here that a coherence manipulation can be done by modifying the multiplication factors $a_1, \ldots, a_n$ such as by multiplying the weighting factors of all subbands with random numbers with values between 20 log 10(−6) and 20 log 10(6). The pseudo-random sequence is preferably chosen such that the variance is approximately constant for all critical bands, and the average is zero within each critical band. The same sequence is applied to the spectral coefficients for each different frame. Thus, the auditory image width is controlled by modifying the variance of the pseudo-random sequence. A larger variance creates a larger image width.

The variance modification can be performed in individual bands that are critical-band wide. This enables the simultaneous existence of multiple objects in an auditory scene, each object having a different image width. A suitable amplitude distribution for the pseudo-random sequence is a uniform distribution on a logarithmic scale as it is outlined in the U.S. patent application publication 2003/0219130 A1. Nevertheless, all BCC synthesis processing is related to a single input channel transmitted as the sum signal from the BCC encoder to the BCC decoder as shown in FIG.

To transmit the five channels in a compatible way, i.e., in a bitstream format, which is also understandable for a normal stereo decoder, the so-called matrixing technique has been used as described in "MUSICAM surround: a universal multi-channel coding system compatible with ISO 11172-3", G. Theile and G. Stoll, AES preprint 3403, October 1992, San Francisco. The five input channels L, R, C, Ls, and Rs are fed into a matrixing device performing a matrixing operation to calculate the basic or compatible stereo channels Lo, Ro, from the five input channels. In particular, these basic stereo channels Lo/Ro are calculated as set out below:

$$Lo=L+xC+yLs$$

$$Ro=R+xC+yRs$$

x and y are constants. The other three channels C, Ls, Rs are transmitted as they are in an extension layer, in addition to a basic stereo layer, which includes an encoded version of the basic stereo signals Lo/Ro. With respect to the bitstream, this Lo/Ro basic stereo layer includes a header, information such as scale factors and subband samples. The multi-channel extension layer, i.e., the central channel and the two surround channels are included in the multi-channel extension field, which is also called ancillary data field.

At a decoder-side, an inverse matrixing operation is performed in order to form reconstructions of the left and right channels in the five-channel representation using the basic stereo channels Lo, Ro and the three additional channels. Additionally, the three additional channels are decoded from the ancillary information in order to obtain a decoded five-channel or surround representation of the original multi-channel audio signal.

Another approach for multi-channel encoding is described in the publication "Improved MPEG-2 audio multi-channel encoding", B. Grill, J. Herre, K. H. Brandenburg, E. Eberlein, J. Koller, J. Mueller, AES preprint 3865, February 1994, Amsterdam, in which, in order to obtain backward compatibility, backward compatible modes are considered. To this end, a compatibility matrix is used to obtain two so-called downmix channels Lc, Rc from the original five input channels. Furthermore, it is possible to dynamically select the three auxiliary channels transmitted as ancillary data.

In order to exploit stereo irrelevancy, a joint stereo technique is applied to groups of channels, e. g. the three front channels, i.e., for the left channel, the right channel and the center channel. To this end, these three channels are combined to obtain a combined channel. This combined channel is quantized and packed into the bitstream.

Then, this combined channel together with the corresponding joint stereo information is input into a joint stereo decoding module to obtain joint stereo decoded channels, i.e., a joint stereo decoded left channel, a joint stereo decoded right channel and a joint stereo decoded center channel. These joint stereo decoded channels are, together with the left surround channel and the right surround channel input into a compatibility matrix block to form the first and the second downmix channels Lc, Rc. Then, quantized versions of both downmix channels and a quantized version of the combined channel are packed into the bitstream together with joint stereo coding parameters.

Using intensity stereo coding, therefore, a group of independent original channel signals is transmitted within a single portion of "carrier" data. The decoder then reconstructs the involved signals as identical data, which are rescaled according to their original energy-time envelopes. Consequently, a linear combination of the transmitted channels will lead to results, which are quite different from the original downmix. This applies to any kind of joint stereo coding based on the intensity stereo concept. For a coding system providing compatible downmix channels, there is a direct consequence: The reconstruction by dematrixing, as described in the previous publication, suffers from artifacts caused by the imperfect reconstruction. Using a so-called joint stereo predistortion scheme, in which a joint stereo coding of the left, the right and the center channels is performed before matrixing in the encoder, alleviates this problem. In this way, the dematrixing scheme for reconstruction introduces fewer artifacts, since, on the encoder-side, the joint stereo decoded signals have been used for generating the downmix channels. Thus, the imperfect reconstruction process is shifted into the compatible downmix channels Lc and Pc, where it is much more likely to be masked by the audio signal itself.

Although such a system has resulted in fewer artifacts because of dematrixing on the decoder-side, it nevertheless has some drawbacks. A drawback is that the stereo-compatible downmix channels Lc and Rc are derived not from the original channels but from intensity stereo coded/decoded versions of the original channels. Therefore, data losses because of the intensity stereo coding system are included in the compatible downmix channels. Astereo-only decoder, which only decodes the compatible channels rather than the enhancement intensity stereo encoded channels, therefore, provides an output signal, which is affected by intensity stereo induced data losses.

Additionally, a full additional channel has to be transmitted besides the two downmix channels. This channel is the combined channel, which is formed by means of joint stereo coding of the left channel, the right channel and the center channel. Additionally, the intensity stereo information to reconstruct the original channels L, R, C from the combined channel also has to be transmitted to the decoder. At the decoder, an inverse matrixing, i.e., a dematrixing operation is performed to derive the surround channels from the two downmix channels. Additionally, the original left, right and center channels are approximated by joint stereo decoding using the transmitted combined channel and the transmitted joint stereo parameters. It is to be noted that the original left, right and center channels are derived by joint stereo decoding of the combined channel.

It has been found out that in case of intensity stereo techniques, when used in combination with multi-channel signals, only fully coherent output signals which are based on the same base channel can be produced.

In BCC techniques, it is quite expensive to reduce the inter-channel coherence in a reconstructed multi-channel output signal, since a pseudo-random number generator for influencing the weighting sectors is required. Additionally, it has been shown that this kind of processing is problematic in that artifacts because of randomly manipulating multiplication factors or time delay factors can be introduced which can become audible under certain circumstances and, therefore, deteriorate the quality of the reconstructed multi-channel output signal.

SUMMARY OF THE INVENTION

It is, therefore, an object of the present invention to provide a concept for a bit-efficient and artifact-reduced processing or inverse processing of a multi-channel audio signal.

In accordance with the first aspect of the present invention, this object is achieved by an apparatus for constructing a multi-channel output signal using an input signal and parametric side information, the input signal including a first input channel and a second input channel derived from an original multi-channel signal, the original multi-channel signal having a plurality of channels, the plurality of channels including at least two original channels, which are defined as being located at one side of an assumed listener position, wherein a first original channel is a first one of the at least two original channels, and wherein a second original channel is a second one of the at least two original channels, and the parametric side information describing interrelations betweens original channels of the multi-channel original signal, comprising: original multi-channel signal; means for determining a first base channel by selecting one of the first and the second input channels or a combination of the first and the second input channels, and for determining a second base channel by selecting the other of the first and the second input channels or a different combination of the first and the second input channels, such that the second base channel is different from the first base channel; and means for synthesizing a first output channel using the parametric side information and the first base channel to obtain a first synthesized output channel which is a reproduced version of the first original channel which is located at the one side of the assumed listener position, and for synthesizing a second output channel using the parametric side information and the second base channel, the second output channel being a reproduced version of the second original channel which is located at the same side of the assumed listener position.

In accordance with the second aspect of the present invention, this object is achieved by a method of constructing a multi-channel output signal using an input signal and parametric side information, the input signal including a first input channel and a second input channel derived from an original multi-channel signal, the original multi-channel signal having a plurality of channels, the plurality of channels including at least two original channels, which are defined as being located at one side of an assumed listener position, wherein a first original channel is a first one of the at least two original channels, and wherein a second original channel is a second one of the at least two original channels, and the parametric side information describing interrelations betweens original channels of the multi-channel original signal, comprising: determining a first base channel by selecting one of the first and the second input channels or a combination of the first and the second input channels, and determining a second base channel by selecting the other of the first and the second input channels or a different combination of the first and the second input channels, such that the second base channel is different from the first base channel; and synthesizing a first output channel using the parametric side information and the first base channel to obtain a first synthesized output channel which is a reproduced version of the first original channel which is located at the one side of the assumed listener position, and synthesizing a second output channel using the parametric side information and the second base channel, the second output channel being a reproduced version of the second original channel which is located at the same side of the assumed listener position.

In accordance with the third aspect of the present invention, this object is achieved by an apparatus for generating a downmix signal from a multi-channel original signal, the downmix signal having a number of channels being smaller than a number of original channels, comprising: means for calculating a first downmix channel and a second downmix channel using a downmix rule; means for calculating parametric level information representing an energy distribution among the channels in the multi-channel original signal; means for determining a coherence measure between two original channels, the two original channels being located at one side of an assumed listener position; and means for forming an output signal using the first and the second downmix channels, the parametric level information and only at least one coherence measure between two original channels located at the one side or a value derived from the at least one coherence measure, but not using any coherence measure between channels located at different sides of the assumed listener position.

In accordance with a fourth aspect of the present invention, this object is achieved by a method for generating a downmix signal from a multi-channel original signal, the downmix signal having a number of channels being smaller than a number of original channels, comprising: calculating a first downmix channel and a second downmix channel using a downmix rule; calculating parametric level information representing an energy distribution among the channels in the multi-channel original signal; determining a coherence measure between two original channels, the two original channels being located at one side of an assumed listener position; and forming an output signal using the first and the second downmix channels, the parametric level information and only at least one coherence measure between two original channels located at the one side or a value derived from the at least one coherence measure, but not using any coherence measure between channels located at different sides of the assumed listener position.

In accordance with a fifth aspect and a sixth aspect of the present invention, this object is achieved by a computer program including the method for constructing the multi-channel output signal or the method of generating a downmix signal.

The present invention is based on the finding that an efficient and artifact-reduced reconstruction of a multi-channel output signal is obtained, when there are two or more channels, which can be transmitted from an encoder to a decoder, wherein the channels which are Preferably a left and a right stereo channel, show a certain degree of incoherence. This will normally be the case, since the left and right stereo channels or the left and right compatible stereo channels as obtained by downmixing a multi-channel signal will usually show a certain degree of incoherence, i.e., will not be fully coherent or fully correlated.

In accordance with the present invention, the reconstructed output channels of the multi-channel output signal are decorrelated from each other by determining different base channels for the different output channels, wherein the different base channels are obtained by using varying degrees of the uncorrelated transmitted channels.

In other words, a reconstructed output channel having, for example, the left transmitted input channel as a base channel would be—in the BCC subband domain—fully correlated with another reconstructed output channel which has the same e.g. left channel as the base channel assuming no extra "correlation synthesis". In this context, it is to be noted that deterministic delay and level settings do not reduce coherence between these channels. In accordance with the present invention, the coherence between these channels, which is 100% in the above example is reduced to a certain coherence degree or coherence measure by using a first base channel for constructing the first output channel and for using a second base channel for constructing the second output channel, wherein the first and second base channels have different "portions" of the two transmitted (de-correlated) channels. This means that the first base channel is influenced stronger by the first transmitted or is even identical to the first transmitted channel, compared to the second base channel which is influenced less by the first channel, i.e., which is more influenced by the second transmitted channel.

In accordance with the present invention, inherent de-correlation between the transmitted channels is used for providing de-correlated channels in a multi-channel output signal.

In a preferred embodiment, a coherence measure between respective channel pairs such as front left and left surround or front right and right surround is determined in an encoder in a time-dependent and frequency-dependent way and transmitted as side information, to an inventive decoder such that a dynamic determination of base channels and, therefore, a dynamic manipulation of coherence between the reconstructed output channels can be obtained.

Compared to the above mentioned prior art case, in which only an ICC cue for the two strongest channels is transmitted, the inventive system is easier to control and provides a better quality reconstruction, since no determination of the strongest channels in an encoder or a decoder are necessary, since the inventive coherence measure always relates to the same channel pair irrespective of the fact, whether this channel pair includes the strongest channels or not. Higher quality compared to the prior art systems is obtained in that two downmixed channels are transmitted from an encoder to a decoder such that the. left/right coherence relation is automatically transmitted such that no extra information on a left/right coherence is required.

A further advantage of the present invention has to be seen in the fact that a decoder-side computing workload can be reduced, since the normal decorrelation processing load can be reduced or even completely eliminated.

Preferably, parametric channel side information for one or more of the original channels are derived such that they relate to one of the downmix channels rather than, as in the prior art, to an additional "combined" joint stereo channel. This means that the parametric channel side information are calculated such that, on a decoder side, a channel reconstructor uses the channel side information and one of the downmix channels or a combination of the downmix channels to reconstruct an approximation of the original audio channel, to which the channel side information is assigned.

This concept is advantageous in that it provides a bit-efficient multi-channel extension such that a multi-channel audio signal can be played at a decoder.

Additionally, the concept is backward compatible, since a lower scale decoder, which is only adapted for two-channel processing, can simply ignore the extension information, i.e., the channel side information. The lower scale decoder can only play the two downmix channels to obtain a stereo representation of the original multi-channel audio signal.

A higher scale decoder, however, which is enabled for multi-channel operation, can use the transmitted channel side information to reconstruct approximations of the original channels.

The present embodiment is advantageous in that it is bit-efficient, since, in contrast to the prior art, no additional carrier channel beyond the first and second downmix channels Lc, Rc is required. Instead, the channel side information are related to one or both downmix channels. This means that the downmix channels themselves serve as a carrier channel, to which the channel side information are combined to reconstruct an original audio channel. This means that the channel side information are preferably parametric side information, i.e., information which do not include any subband samples or spectral coefficients. Instead, the parametric side information are information used for weighting (in time and/or frequency) the respective downmix channel or the combination of the respective downmix channels, to obtain a reconstructed version of a selected original channel.

In a preferred embodiment of the present invention, a backward compatible coding of a multi-channel signal based on a compatible stereo signal is obtained. Preferably, the compatible stereo signal (downmix signal) is generated using matrixing of the original channels of multi-channel audio signal.

Preferably, channel side information for a selected original channel is obtained based on joint stereo techniques such as intensity stereo coding or binaural cue coding. Thus, at the decoder side, no dematrixing operation has to be performed. The problems associated with dematrixing, i.e., certain artifacts related to an undesired distribution of quantization noise in dematrixing operations, are avoided. This is due to the fact that the decoder uses a channel reconstructor, which reconstructs an original signal, by using one of the downmix channels or a combination of the downmix channels and the transmitted channel side information.

Preferably, the inventive concept is applied to a multi-channel audio signal having five channels. These five channels are a left channel L, a right channel R, a center channel C, a left surround channel Ls, and a right surround channel Rs. Preferably, downmix channels are stereo compatible downmix channels Ls and Rs, which provide a stereo representation of the original multi-channel audio signal.

In accordance with the preferred embodiment of the present invention, for each original channel, channel side information are calculated at an encoder side packed into output data. Channel side information for the original left channel are derived using the left downmix channel. Channel side information for the original left surround channel are derived using the left downmix channel. Channel side information for the original right channel are derived from the right downmix channel. Channel side information for the original right surround channel are derived from the right downmix channel.

In accordance with the preferred embodiment of the present invention, channel information for the original center channel are derived using the first downmix channel as well as the second downmix channel, i.e., using a combination of the two downmix channels. Preferably, this combination is a summation.

Thus, the groupings, i.e., the relation between the channel side information and the carrier signal, i.e., the used downmix channel for providing channel side information for a selected original channel are such that, for optimum quality, a certain downmix channel is selected, which contains the highest possible relative amount of the respective original multi-channel signal which is represented by means of channel side information. As such a joint stereo carrier signal, the first and the second downmix channels are used. Preferably, also the sum of the first and the second downmix channels can be used. Naturally, the sum of the first and second downmix channels can be used for calculating channel side information for each of the original channels. Preferably, however, the sum of the downmix channels is used for calculating the channel side information of the original center channel in a surround environment, such as five channel surround, seven channel surround, 5.1 surround or 7.1 surround. Using the sum of the first and second downmix channels is especially advantageous, since no additional transmission overhead has to be performed. This is due to the fact that both downmix channels are present at the decoder such that summing of these downmix channels can easily be performed at the decoder without requiring any additional transmission bits.

Preferably, the channel side information forming the multi-channel extension are input into the output data bit stream in a compatible way such that a lower scale decoder simply ignores the multi-channel extension data and only provides a stereo representation of the multi-channel audio signal.

Nevertheless, a higher scale encoder not only uses two downmix channels, but, in addition, employs the channel side information to reconstruct a full multi-channel representation of the original audio signal.

BRIEF DESCRIPTION OF THE DRAWINGS

Preferred embodiments of the present invention are subsequently described by referring to the enclosed drawings, in which:

FIG. 1A is a block diagram of a preferred embodiment of the inventive encoder;

FIG. 2A is a block diagram of a preferred embodiment of the inventive decoder;

FIG. 2E is a schematic representation of a means for determining a coherence measure in an inventive encoder;

FIG. 2F is a schematic representation of a preferred example for determining a weighting factor for calculating a base channel having a certain coherence measure with respect to another base channel;

FIG. 4 illustrates another preferred embodiment of the means for calculating channel side information, in which the channel side information are gain factors;

FIG. 5 illustrates a preferred embodiment of an implementation of the decoder, when the encoder is implemented as in FIG. 4;

FIG. 6 illustrates a preferred implementation of the means for providing the downmix channels;

FIG. 7 illustrates groupings of original and downmix channels for calculating the channel side information for the respective original channels;

DETAILED DESCRIPTION OF PREFERRED EMBODIMENTS

Figure 1B:
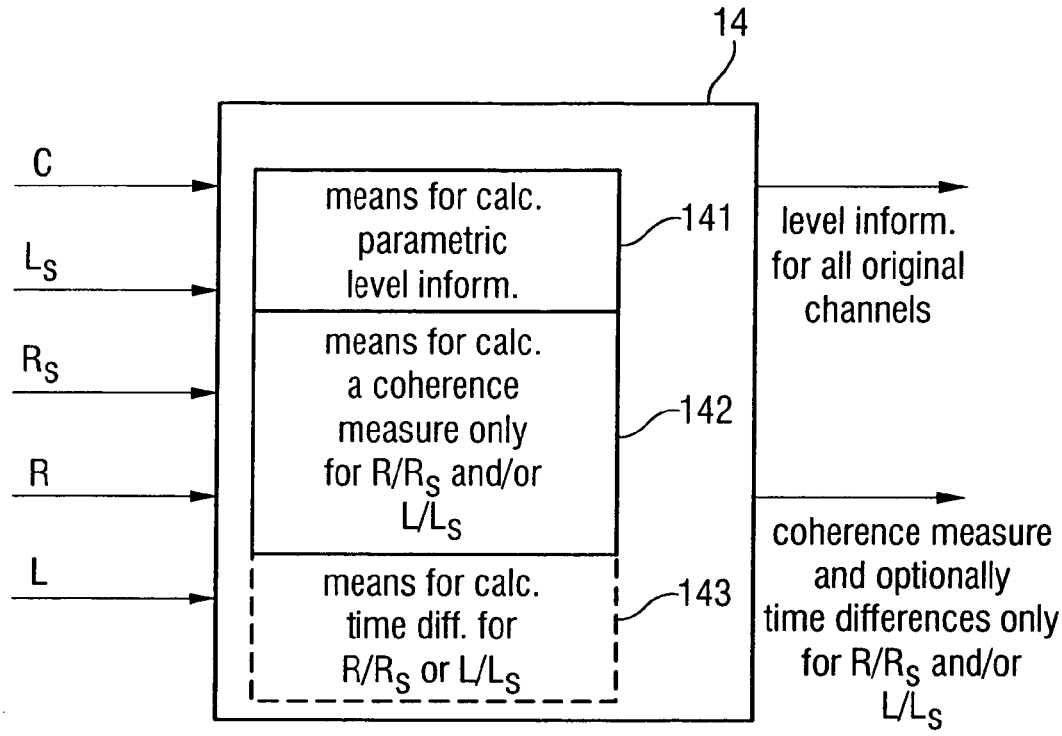
FIG. 1B is a block diagram of an inventive encoder for providing a coherence measure for respective input channel pairs.

FIG. 1A shows an apparatus for processing a multi-channel audio signal 10 having at least three original channels such as R, L and C. Preferably, the original audio signal has more than three channels, such as five channels in the surround environment, which is illustrated in FIG. 1A. The five channels are the left channel L, the right channel R, the center channel C, the left surround channel Ls and the right surround channel Rs. The inventive apparatus includes means 12 for providing a first downmix channel Lc and a second downmix channel Fc, the first and the second downmix channels being derived from the original channels. For deriving the downmix channels from the original channels, there exist several possibilities. One possibility is to derive the downmix channels Lc and Rc by means of matrixing the original channels using a matrixing operation as illustrated in FIG. 6. This matrixing operation is performed in the time domain.

The matrixing parameters a, b and t are selected such that they are lower than or equal to 1. Preferably, a and b are 0.7 or 0.5. The overall weighting parameter t is preferably chosen such that channel clipping is avoided.

Alternatively, as it is indicated in FIG. 1A, the downmixing channels Lc and Rc can also be externally supplied. This may be done, when the downmix channels Lc and Rc are the result of a "hand mixing" operation. In this scenario, a sound engineer mixes the downmix, channels by himself rather than by using an automated matrixing operation. The sound engineer performs creative mixing to get optimized downmix channels Lc and Rc which give the best possible stereo representation of the original multi-channel audio signal.

In case of an external supply of the downmix channels, the means for providing does not perform a matrixing operation but simply forwards the externally supplied downmix channels to a subsequent calculating means 14.

The calculating means 14 is operative to calculate the channel side information such as $l_i$, $ls_i$, $r_i$ or $rs_i$ for selected original channels such as L, Ls, R or Rs, respectively. In particular, the means 14 for calculating is operative to calculate the channel side information such that a downmix channel, when weighted using the channel side information, results in an approximation of the selected original channel.

Alternatively or additionally, the means for calculating channel side information is further operative to calculate the channel side information for a selected original channel such that a combined downmix channel including a combination of the first and second downmix channels, when weighted using the calculated channel side information results in an approximation of the selected original channel. To show this Feature in the figure, an adder 14*a* and a combined channel side information calculator 14*b* are shown.

It is clear for those skilled in the art that these elements do not have to be implemented as distinct elements. Instead, the whole functionality of the blocks 14, 14*a*, and 14*b* can be implemented by means of a certain processor which may be a general purpose processor or any other means for performing the required functionality.

Additionally, it is to be noted here that channel signals being subband samples or frequency domain values are indicated in capital letters. Channel side information are, in contrast to the channels themselves, indicated by small letters. The channel side information $c_i$ is, therefore, the channel side information for the original center channel C.

The channel side information as well as the downmix channels Lc and Rc or an encoded version Lc' and Rc' as produced by an audio encoder 16 are input into an output data formatter 18. Generally, the output data formatter 18 acts as means for generating output data, the output data including the channel side information for at least one original channel, the first downmix channel or a signal derived from the first downmix channel (such as an encoded version thereof) and the second downmix channel or a signal derived from the second downmix channel (such as an encoded version thereof).

The output data or output bitstream 20 can then be transmitted to a bitstream decoder or can be stored or distributed. Preferably, the output bitstream 20 is a compatible bitstream which can also be read by a lower scale decoder not having a multi-channel extension capability. Such lower scale encoders such as most existing normal state of the art mp3 decoders will simply ignore the multi-channel extension data, i.e., the channel side information. They will only decode the first and second downmix channels to produce a stereo output. Higher scale decoders, such as multi-channel enabled decoders will read the channel side information and will then generate an approximation of the original audio channels such that a multi-channel audio impression is obtained.

Figure 8:
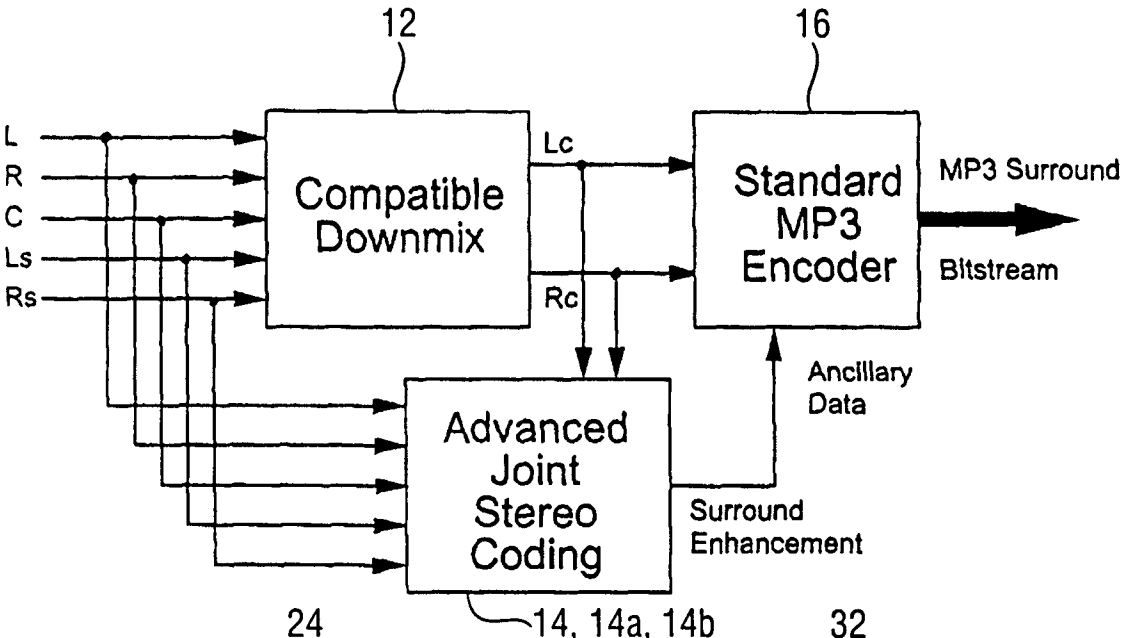
FIG. 8 illustrates another preferred embodiment of an inventive encoder.

FIG. 8 shows a preferred embodiment of the present invention in the environment of five channel surround/mp3. Here, it is preferred to write the surround enhancement data into the ancillary data field in the standardized mp3 bit stream syntax such that an "mp3 surround" bit stream is obtained.

FIG. 1B illustrates a more detailed representation of element 14 in FIG. 1A. In a preferred embodiment of the present invention, a calculator 14 includes means 141 for calculating parametric level information representing an energy distribution among the channels in the multi channel original signal shown at 10 in FIG. 1A. Element 141 therefore is able to generate output level information for all original channels. In a preferred embodiment, this level information includes ICLD parameters obtained by regular BCC synthesis as has been described in connection with FIGS. 10 to 13.

Element 14 further comprises means 142 for determining a coherence measure between two original channels located at one side of an assumed listener position. In case of the 5-channel surround example shown in FIG. 1A, such a channel pair includes the right channel P and the right surround channel $R_s$ or, alternatively or additionally the left channel L and the left surround channel $L_s$. Element 14 alternatively further comprises means 143 for calculating the time difference for such a channel pair, i.e., a channel pair having channels which are located at one side of an assumed listener position.

The output data formatter 18 From FIG. 1A is operative to input into the data stream at 20 the level information representing an energy distribution among the channels in the multi channel original signal and a coherence measure only for the left and left surround channel pair and/or the right and the right surround channel pair. The output data formatter, however, is operative to not include any other coherence measures or optionally time differences into the output signal such that the amount of side information is reduced compared to the prior art scheme in which ICC cues for all possible channel pairs were transmitted.

Figure 14A:
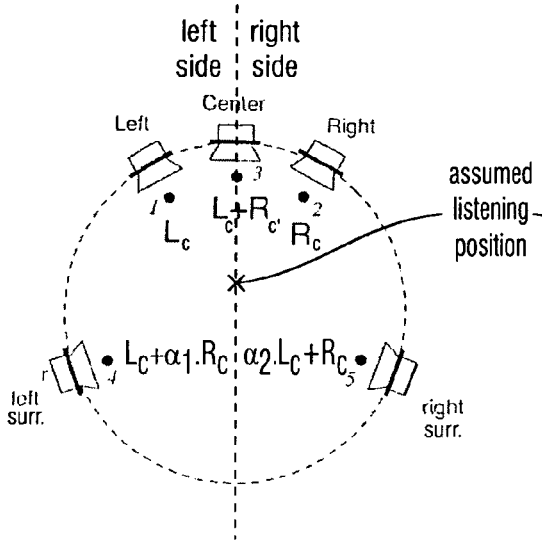
FIG. 14A is a schematic representation of the scheme for attributing different base channels for the reproduction of different output channels.
Figure 14B:
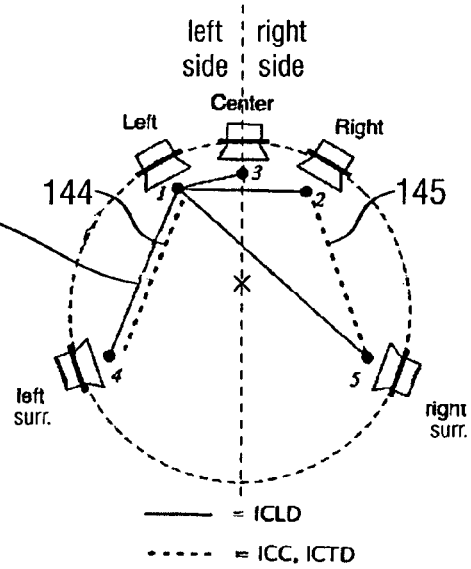
FIG. 14B is a representation of the channel pairs necessary for determining ICC and ICTD parameters.

To illustrate the inventive encoder as shown in FIG. 1B in more detail, reference is made to FIG. 14A and FIG. 14B. In FIG. 14A, an arrangement of channel speakers for an example 5-channel system is given with respect to a position of an assumed listener position which is located at the center point of a circle on which the respective speakers are placed. As outlined above, the 5-channel system includes a left surround channel, a left channel, a center channel, a right channel and a right surround channel. Naturally, such a system can also include a subwoofer channel which is not shown in FIG. 14.

It is to be noted here that the left surround channel can also be termed as "rear left channel". The same is true for the right surround channel. This channel is also known as the rear right channel.

Figure 11:
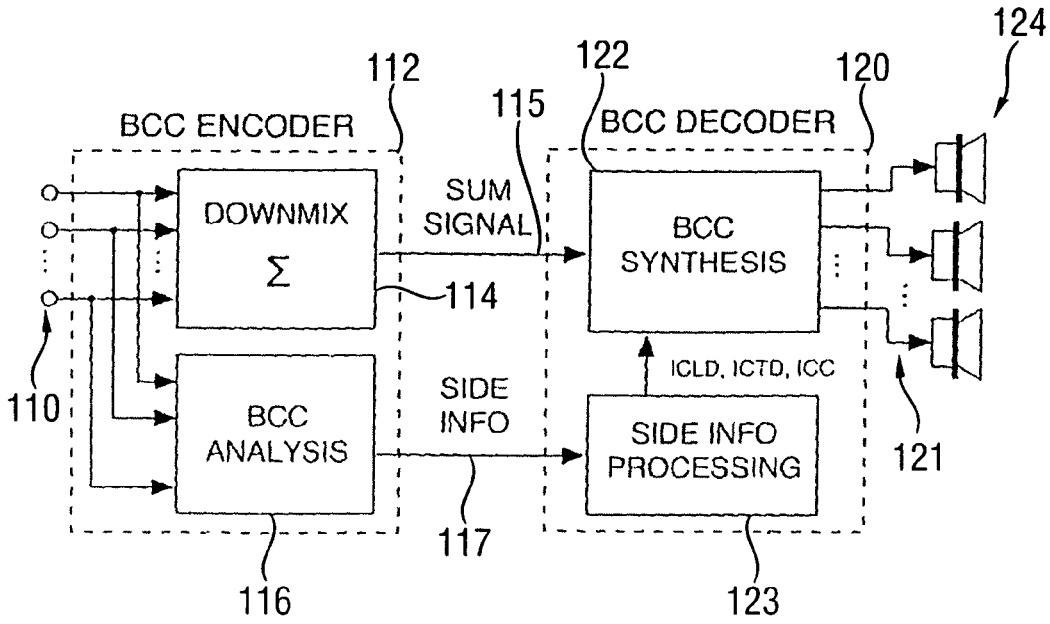
FIG 11 (Prior Art)
FIG. 11 is a block diagram representation of a prior art BCC encoder/decoder chain?
Figure 12:
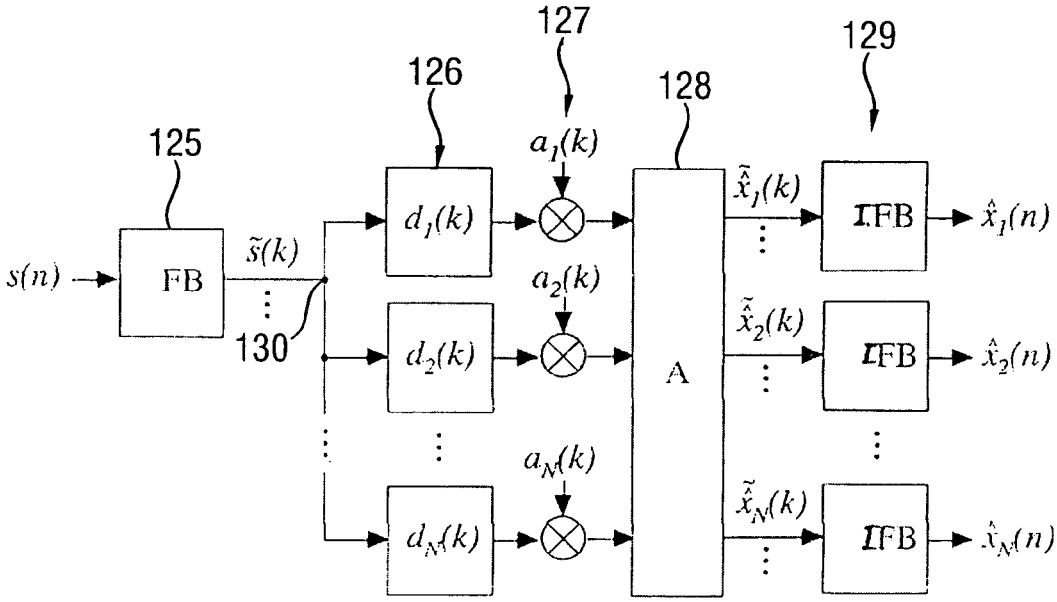
FIG 12 (Prior Art)
FIG. 12 is a block diagram of a prior art implementation of a BCC synthesis block of FIG. 11.
Figure 13:
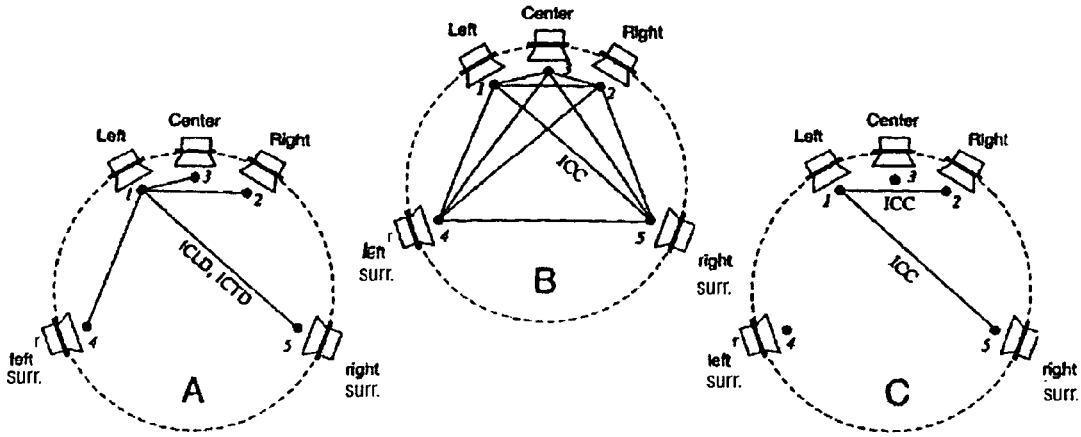
FIG 13 (Prior Art)
FIG. 13 is a representation of a well-known scheme for determining ICLD, ICTD and ICC parameters.

In contrast to state of the art BCC with one transmission channel, in which the same base channel, i.e., the transmitted mono signal as shown in FIG. 11 is used for generating each of the N output channels, the inventive system uses, as a base channel, one of the N transmitted channels or a linear combination thereof as the base channel for each of the N output channels.

Therefore, FIG. 14 shows a NtoM scheme, i. e. a scheme, in which N original channels are downmixed to two downmix channels. In the example of FIG. 14, N is equal to 5 while M is equal to 2. In particular, for the front left channel reconstruction, the transmitted left channel $L_c$ is used. Analogously, for the front right channel reconstruction, the second transmitted channel $R_c$ is used as the base channel. Additionally, an equal combination of $L_c$ and $R_c$ is used as the base channel for reconstructing the center channel. In accordance with an embodiment of the present invention, correlation measures are additionally transmitted from an encoder to a decoder. Therefore, for the left surround channel, not only the transmitted left channel $L_c$ is used but the transmitted channel $L_c+\alpha_1 R_c$ such that the base channel for reconstructing the left surround channel is not fully coherent to the base channel for reconstructing the front left channel. Analogously, the same procedure is performed for the right side (with respect to the assumed listener position), in that the base channel for reconstructing the right surround channel is different from constructing the right surround channel is different from the base channel for reconstructing the front right channel, wherein the difference is dependent on the coherence measure $\alpha_2$ which is preferable transmitted from an encoder to a decoder as side information.

The inventive process, therefore, is unique in that for the reproduction of preferable each output channel, a different base channel is used, wherein the base channels are equal to the transmitted channels or a linear combination thereof. This linear combination can depend on the transmitted base channels on varying degrees, wherein these degrees depend on coherence measures which depends on the original multichannel signal.

The process of obtaining the N base channels given the M transmitted channels is called "upmixing". This upmixing can be implemented by multiplying a vector with the transmitted channels by a N×M matrix to generate N base channels. By doing so, linear combinations of transmitted signal channels are formed to produce the base signals for the output channel signals. A specific example for upmixing is shown in FIG. 14A, which is a 5 to 2-scheme applied for generating a 5-channel surround output signal with a 2-channel stereo transmission. Preferably, the base channel for an additional subwoofer output channel is the same as the center channel L+R. In a preferred embodiment of the present invention, a time-varying and—optionally—frequency-varying coherence measure is provided such that a time-adaptive upmixing matrix, which is—optionally—also frequency-selective is obtained.

In the following, reference is made to FIG. 14B showing a background for the inventive encoder implementation illustrated in FIG. 1B. In this context, it is to be noted that ICC and ICTD cues between left and right and left surround and right surround are the same as in the transmitted stereo signal. Thus, there is, in accordance with the present invention, no need for using ICC and ICTD cues between left and right and left surround and right surround for synthesizing or reconstructing an output signal. Another reason for not synthesizing ICC and ICTD cues between left and right and left surround and right surround is the general objective stating that the base channels have to be modified as little as possible to maintain maximum signal quality. Any signal modification potentially introduces artifacts or non-naturalness.

Therefore, only a level representation of the original multichannel signal which is obtained by providing the ICLD cues is provided, while, in accordance with the present invention, ICC and ICTD parameters are only calculated and transmitted for channel pairs to one side of the assumed listener position. This is illustrated by the dotted line 144 for the left side and the dotted line 145 for the right side in FIG. 148. In contrast to ICC and ICTD, ICLD synthesis is rather nonproblematic with respect to artifacts and non-naturalness because it just involves scaling of subband signals. Thus, ICLDs are synthesized as generally as in regular BCC, i.e., between a reference channel and all other channels. More generally speaking, in a N 2 M scheme, ICLDs are synthesized between channel pairs similar to regular BCC. ICC and ICTD cues, however, are, in accordance with the present invention, only synthesized between channel pairs which are on the same side with respect to the assumed listener position, i.e., for the channel pair including the front left and the left surround channel or the channel pair including the front right and the right surround channel.

In case of 7-channel or higher surround systems, in which there are three channels on the left side and three channels on the right side, the same scheme can be applied, wherein only for possible channel pairs on the left side or the right side, coherence parameters are transmitted for providing different base channels for the reconstruction of the different output channels on one side of the assumed listener position. The inventive NtoM encoder as shown in FIG. 1A and FIG. 1B is, therefore, unique in that the input signals are downmixed not into one single channel but into M channels, and that ICTD and ICC cues are estimated and transmitted only between the channel pairs for which this is necessary.

In a 5-channel surround system, the situation is shown in FIG. 14B from which it becomes clear that at least one coherence measure between left and left surround has to be transmitted. This coherence measure can also be used for providing decorrelation between right and right surround. This is a low side information implementation. In case one has more available channel capacity, one can also generate and transmit a separate coherence measure between the right and the right surround channel such that, in an inventive decoder, also different degrees of decorrelation on the left side and on the right side can be obtained.

FIG. 2A shows an illustration of an inventive decoder acting as an apparatus for inverse processing input data received at an input data port 22. The data received at the input data port 22 is the same data as output at the output data port 20 in FIG. 1A. Alternatively, when the data are not transmitted via a wired channel but via a wireless channel, the data received at data input port 22 are data derived from the original data produced by the encoder.

The decoder input data are input into a data stream reader 24 for reading the input data to finally obtain the channel side information 26 and the left downmix channel 28 and the right downmix channel 30. In case the input data includes encoded versions of the downmix channels, which corresponds to the case, in which the audio encoder 16 in FIG. 1A is present, the data stream reader 24 also includes an audio decoder, which is adapted to the audio encoder used for encoding the downmix channels. In this case, the audio decoder, which is part of the data stream reader 24, is operative to generate the first downmix channel Lc and the second downmix channel Rc, or, stated more exactly, a decoded version of those channels. For ease of description, a distinction between signals and decoded versions thereof is only made where explicitly stated.

The channel side information 26 and the left and right downmix channels 28 and 30 output by the data stream reader 24 are fed into a multi-channel reconstructor 32 for providing a reconstructed version 34 of the original audio signals, which can be played by means of a multi-channel player 36. In case the multi-channel reconstructor is operative in the frequency domain, the multi-channel player 36 will receive frequency domain input data, which have to be in a certain way decoded such as converted into the time domain before playing them. To this end, the multi-channel player 36 may also include decoding facilities.

It is to be noted here that a lower scale decoder will only have the data stream reader 24, which only outputs the left and right downmix channels 28 and 30 to a stereo output 38. An enhanced inventive decoder will, however, extract the channel side information 26 and use these side information and the downmix channels 28 and 30 for reconstructing reconstructed versions 34 of the original channels using the multi-channel reconstructor 32.

Figure 2B:
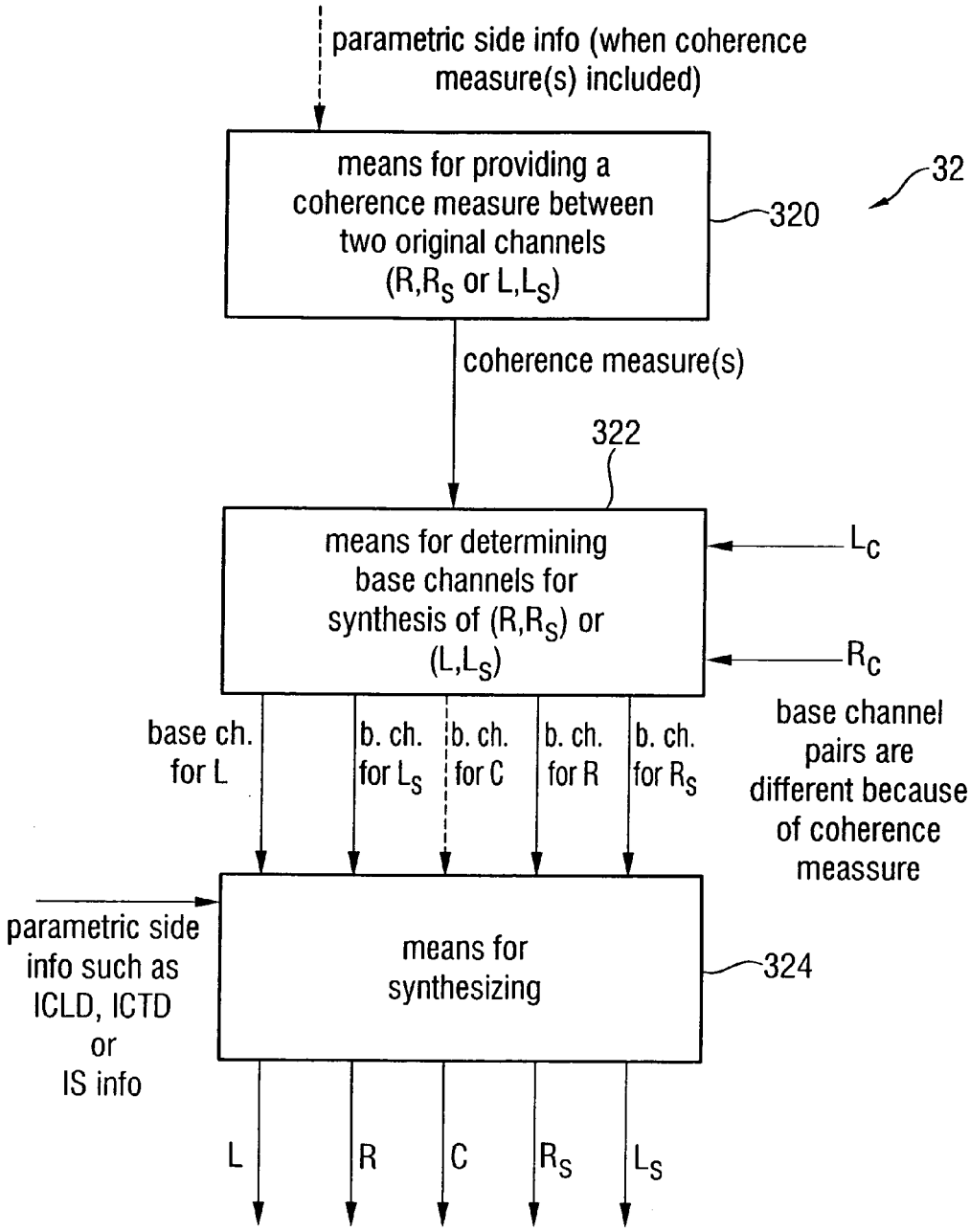
FIG. 2B is a block diagram of an inventive decoder having different base channels for different output channels.

FIG. 2B shows an inventive implementation of the multi-channel reconstructor 32 of FIG. 2A. Therefore, FIG. 2B shows an apparatus for constructing a multi-channel output signal using an input signal and parametric side information, the input signal including a first input channel and a second input channel derived from an original multi-channel signal, and the parametric side information describing interrelations between channels of the multi-channel original signal. The inventive apparatus shown in FIG. 2B includes means 320 for providing a coherence measure depending on a first original channel and a second original channel, the first original channel and the second original channel being included in the original multi-channel signal. In case the coherence measure is included in the parametric side information, the parametric side information is input into means 320 as illustrated in FIG. 2B. The coherence measure provided by means 320 is input into means 322 for determining base channels. In particular, the means 322 is operative for determining a first base channel by selecting one of the first and the second input channels or a predetermined combination of the first and the second input channels. Means 322 is further operative to determine a second base channel using the coherence measure such that the second base channel is different from the first base channel because of the coherence measure. In the example shown in FIG. 2B, which is related to the 5-channel surround system, the first input channel is the left compatible stereo channel $L_c$; and the second input channel is the right compatible stereo channel $R_c$. The means 322 is operative to determine the base channels which have already been described in connection with FIG. 14A. Thus, at the output of means 322, a separate base channel for each of the to be reconstructed output channels is obtained, wherein, preferably, the base channels output by means 322 are all different from each other, i.e., have a coherence measure between themselves, which is different for each pair.

The base channels output by means 322 and parametric side information such as ICLD, ICTD or intensity stereo information are input into means 324 for synthesizing the first output channel such as L using the parametric side information and the first base channel to obtain a first synthesized output channel L, which is a reproduced version of the corresponding first original channel, and for synthesizing a second output channel such as Ls using the parametric side information and the second base channel, the second output channel being a reproduced version of the second original channel. In addition, means 324 for synthesizing is operative to reproduce the right channel R and the right surround channel Rs using another pair of base channels, wherein the base channels in this other pair are different from each other because of the coherence measure or because of an additional coherence measure which has been derived for the right/right surround channel pair.

Figure 2C:
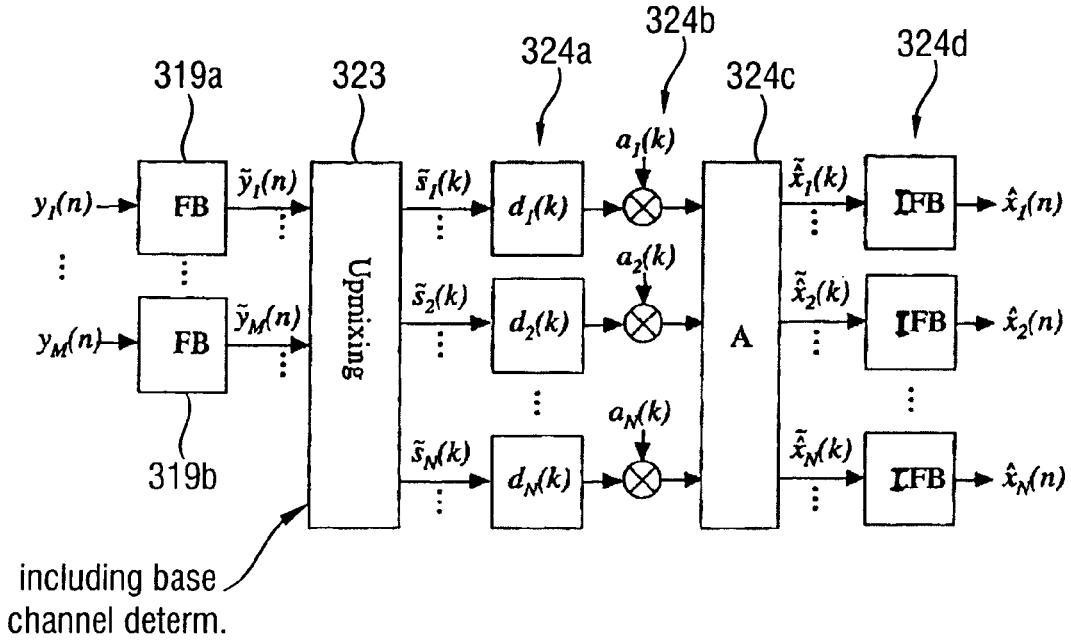
FIG. 2C is a block diagram of a preferred embodiment of the means for synthesizing of FIG. 2B.

A more detailed implementation of the inventive decoder is shown in FIG. 2C. It can be seen that in the preferred embodiment which is shown in FIG. 2C, the general structure is similar to the structure which has already been described in connection with FIG. 12 for a state of the art prior art BCC decoder. Contrary to FIG. 12, the inventive scheme shown in FIG. 2C includes two audio filter banks, i.e., one filter bank for each input signal. Naturally, a single filter bank is also sufficient. In this case, a control is required which inputs into the single filter bank the input signals in a sequential order. The filter banks are illustrated by blocks 319*a* and 319*b*. The functionality of elements 320 and 322—which are illustrated in FIG. 2B—is included in an upmixing block 323 in FIG. 2C.

At the output of the upmixing block 323, base channels, which are different from each other, are obtained. This is in contrast to FIG. 12, in which the base channels on node 130 are identical to each other. The synthesizing means 324 shown in FIG. 2B includes preferably a delay stage 324*a*, a level modification stage 324*b* and, in some cases, a processing stage for performing additional processing tasks 324*c* as well as a respective number of inverse audio filter banks 324*d*. In one embodiment, the functionality of elements 324*a*, 324*b*, 324*c* and 324*d* can be the same as in the prior art device described in connection with FIG. 12.

Figure 2D:
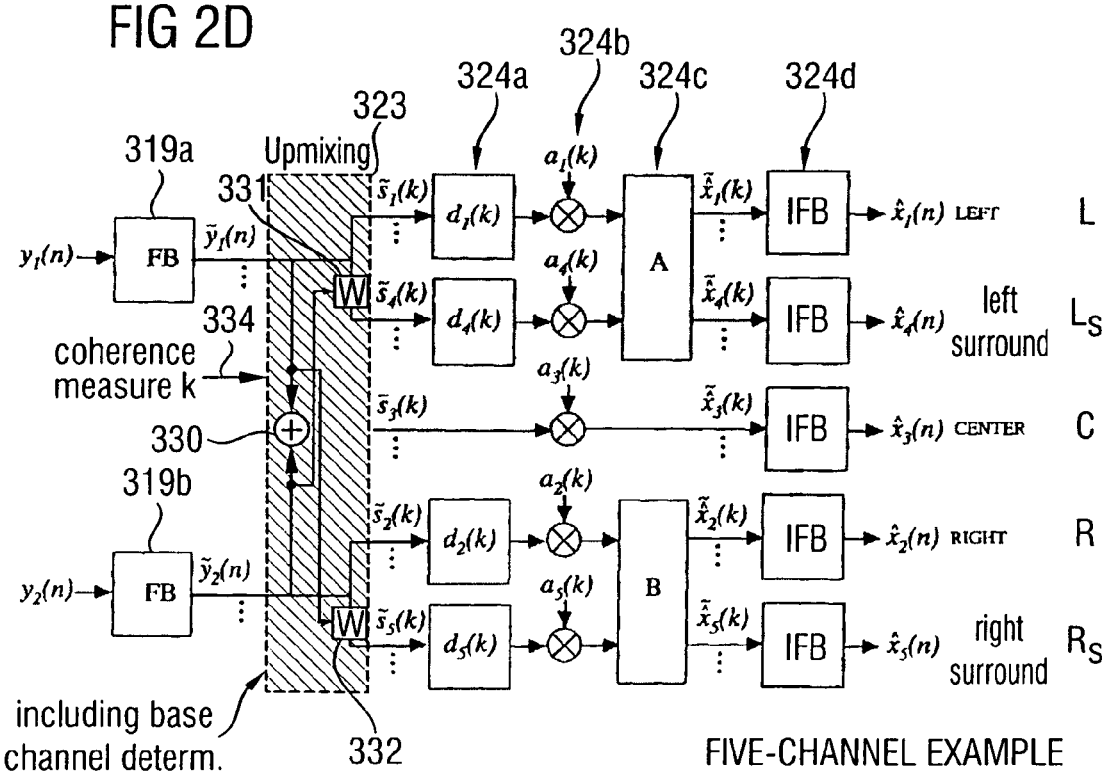
FIG. 2D is a block diagram of a preferred embodiment of apparatus shown in FIG. 2C for a 5-channel surround system.

FIG. 2D shows a more detailed example of FIG. 2C for a 5-channel surround set up, in which two input channels $y_1$ and $y_2$ are input and five constructed output channels are obtained as shown in FIG. 2D. In contrast to FIG. 2C, a more detailed design of the upmixing block 323 is given. In particular, a summation device 330 for providing the base channels for reconstructing a center output channel is shown. Additionally, two blocks 331, 332 titled "W" are shown in FIG. 2D. These blocks perform the weighted combination of the two input channels based on the coherence measure K which is input at a coherence measure input 334. Preferably, the weighting block 331 or 332 also performs respective post processing operations for the base channels such as smoothing in time and frequency as will be outlined below. Thus, FIG. 2C is a general case of FIG. 2D, wherein FIG. 2C illustrates how the N output channels are generated, given the decoder's M input channels. The transmitted signals are transformed to a sub band domain.

The process of computing the base channels for each output channel is denoted upmixing, because each base channel is preferably a linear combination of the transmitted channels. The upmixing can be performed in the time domain or in the sub band or frequency domain.

For computing each base channel, a certain processing can be applied to reduce cancellation/amplification effects when the transmitted channels are out-of-phase or in-phase. ICTD are synthesized by imposing delays on the sub band signals and ICLD are synthesized by scaling the sub band signals. Different techniques can be used for synthesizing ICC such as manipulating the weighting factors or the time delays by means of a random number sequence. It is, however, to be noted here that preferably, no coherence/correlation processing between output channels except the inventive determination of the different base channels for each output channel is performed. Therefore, a preferred inventive device processes ICC cues received from an encoder for constructing the base channels and ICTD and ICLD cues received from an encoder for manipulating the already constructed base channel. Thus, ICC cues or—more generally speaking—coherence measures are not used for manipulating a base channel but are used for constructing the base channel which is manipulated later on.

In the specific example shown in FIG. 20, a 5-channel surround signal is decoded from a 2-channel stereo transmission. A transmitted 2-channel stereo signal is converted to a sub band domain. Then, upmixing is applied to generate five preferable different base channels. ICTD cues are only synthesized between left and left surround, and right and right surround by applying delays $d_1$ (k) as has been discussed in connection with FIG. 14B. Also, the coherence measures are used for constructing the base channels (blocks 331 and 332) in FIG. 2D rather than for doing any post processing in block 324*c*.

Inventively, the ICC and ICTD cues between left and right and left surround and right surround are maintained as in the transmitted stereo signal. Therefore, a single ICC cue and a single ICTD cue parameter will be sufficient and will, therefore, be transmitted from an encoder to a decoder.

In another embodiment, ICC cues and ICTO cues for both sides can be calculated in an encoder. These two values can be transmitted from an encoder to a decoder. Alternatively, the encoder can compute a resulting ICC or ICTD cue by inputting the cues for both sides into a mathematical function such as an averaging function etc for deriving the resulting value from the two coherence measures.

In the following, reference is made to FIGS. 15A and 15B to show a low-complexity implementation of the inventive concept. While a high-complexity implementation requires an encoder-side determination of the coherence measure at least between a channel pair on one side of the assumed listener position, and transmitting of this coherence measure preferably in a quantized and entropy-encoded form, the low-complexity version does not require any coherence measure determination on the encoder-side and any transmission from the encoded to the decoder of such information. In order to, nevertheless, obtain a good subjective quality of the reconstructed multi channel output signal, a predetermined coherence measure or, stated in other words, predetermined weighting factors for determining a weighted combination of the transmitted input channels using such a predetermined weighting factor is provided by the means 324 in FIG. 2D. There exist several possibilities to reduce coherence in base channels for the reconstruction of output channels. Without the inventive measure, the respective output channels would be, in a base line implementation, in which no ICC and ICTD are encoded and transmitted, fully coherent. Therefore, any use of any predetermined coherence measure will reduce coherence in reconstructed output signals such that the reproduced output signals are better approximations of the corresponding original channels.

Figure 15A:
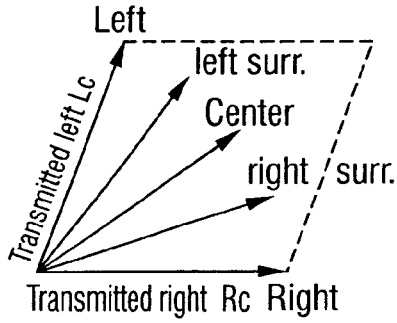
FIG. 15A a schematic representation of a first selection of base channels for constructing a 5-channel output signal.
Figure 15B:
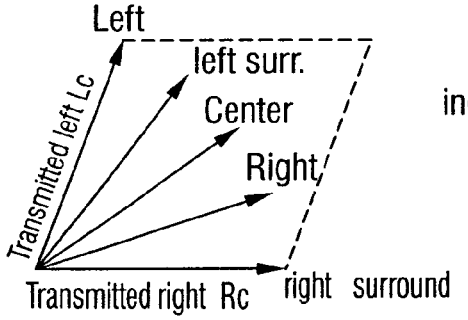
FIG. 15B a schematic representation of a second selection of base channels for constructing a 5-channel output signal.

To therefore prevent that base channels are fully coherent, the upmixing is done as shown for example in FIG. 15A as one alternative or FIG. 15B as another alternative. The five base channels are computed such that none of them are fully coherent, if the transmitted stereo signal is also not fully coherent. This results in that an inter-channel coherence between the left channel and the left surround channel or between the right channel and the right surround channel is automatically reduced, when the inter-channel coherence between the left channel and the right channel is reduced. For example, for an audio signal which is independent between all channels such as an applause signal, such upmixing has the advantage that a certain independence between left and left surround and right and right surround is generated without a need for synthesizing (and encoding) inter-channel coherence explicitly. Of course, this second version of upmixing can be combined with a scheme which still synthesizes ICC and ICTD.

FIG. 15A shows an upmixing optimized for front left and front right, in which most independence is maintained between the front left and the front right.

FIG. 15B shows another example, in which front left and front right on the one hand and left surround and right surround on the other hand are treated in the same way in that the degree of independence of the front and rear channels is the same. This can be seen in FIG. 15B by the fact that an angle between front left/right is the same as the angle between left surround/right.

In accordance with the preferred embodiment of the present invention, dynamic upmixing instead of a static selection, is used. To this end, the invention also relates to an enhanced algorithm which is able to dynamically adapt the upmixing matrix in order to optimize a dynamic performance. In the example illustrated below, the upmixing matrix can be chosen for the back channels such that optimum reproduction of front-rear coherence becomes possible. The inventive algorithm comprises the following steps:

For the front channels, a simply assignment of base channels is used, as the one described in FIG. 14A or 15A. By this simple choice, coherence of the channels along the left/right axis is preserved.

In the encoder, the front-back coherence values such as ICC cues between left/left surround and preferably between right/right surround pairs are measured.

In the decoder, the base channels for the left rear and right rear channels are determined by forming linear combinations of the transmitted channel signals, i.e., a transmitted left channel and a transmitted right channel. Specifically, upmixing coefficients are determined such that the actual coherence between left and left surround and right and right surround achieves the values measured in the encoder. For practical purposes, this can be achieved when the transmitted channel signals exhibit sufficient decorrelations, which is normally the case in usual 5-channel scenarios.

Figure 2G:
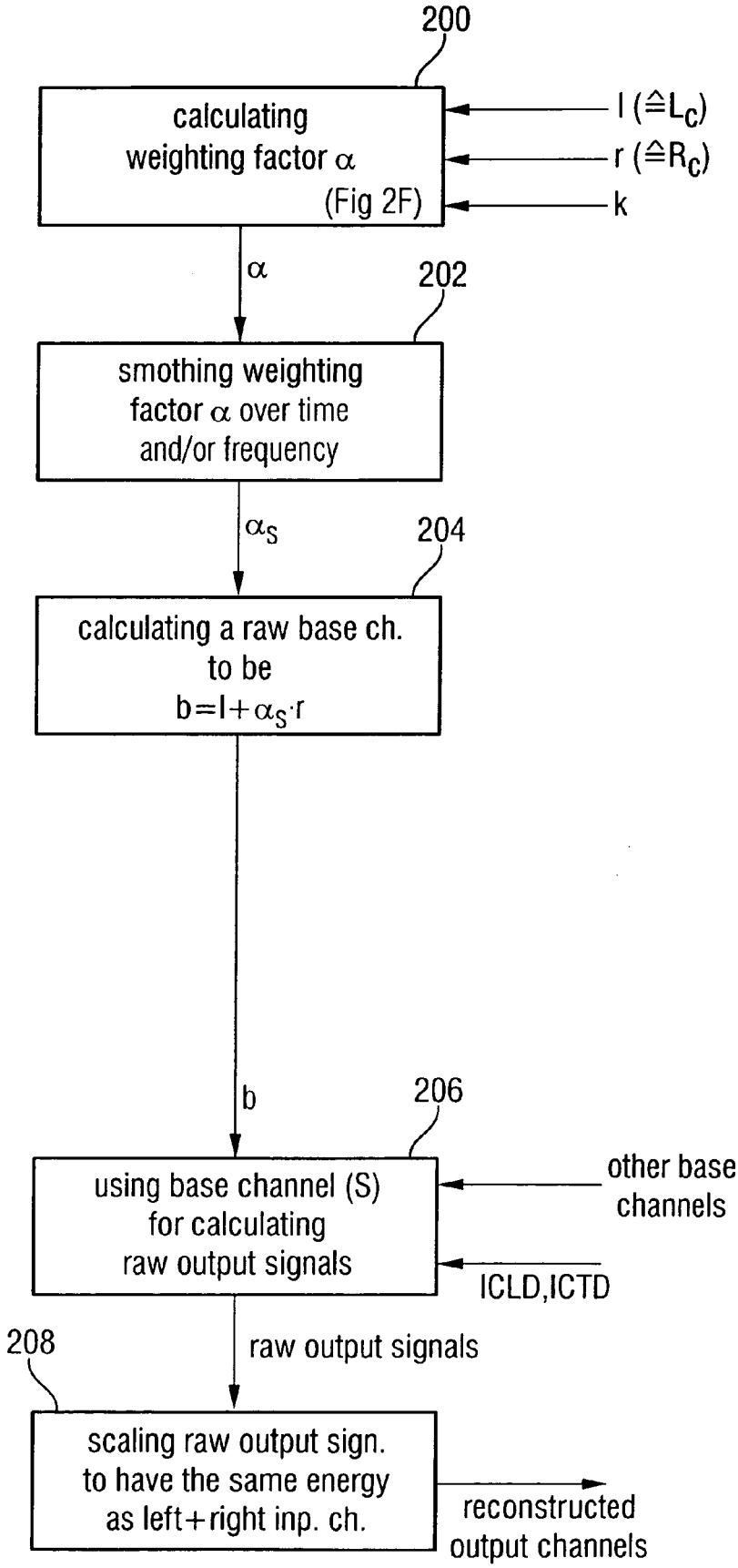
FIG. 2G is a schematic diagram of a preferred way to obtain a reconstructed output channel based on a certain weighting factor calculated by the scheme shown in FIG. 2F.

In the preferred embodiment of dynamic upmixing, an example of an implementation which is regarded as the best mode of carrying out the present invention, will be given with respect to FIG. 2E as to an encoder implementation and FIG. 2F and FIG. 2G with respect to a decoder implementation. FIG. 2E shows one example for measuring front/back coherence values (ICC values) between the left and the left surround channel or between the right and the right surround channel, i.e., between a channel pair located at one side with respect to an assumed listener position.

The equation shown in the box in FIG. 2E gives a coherence measure cc between the first channel x and the second channel y. In one case, the first channel x is the left channel, while the second channel y is the left surround channel. In another case, the first channel x is the right channel, while the second channel y is the right surround channel. $x_i$ stands for a sample of the respective channel x at the time instance i, while $y_i$ stands for a sample at a time instance of the other original channel y. It is to be noted here that the coherence measure can be calculated completely in the time domain. In this case, the summation index i runs from a lower border to an upper border, wherein the other border normally is the same as the number of samples in one frame in case of a frame-wise processing.

Alternatively, coherence measures can also be calculated between band pass signals, i.e., signals having reduced band widths with respect to the original audio signal. In the latter case, the coherence measure is not only time-dependent but also frequency-dependent. The resulting front/back ICC cues, i.e., $CC_1$ for the left front/back coherence and $CC_r$ for the right front/back coherence are transmitted to a decoder as parametric side information preferably in quantized and encoded form.

In the following, reference will be made to FIG. 2F for showing a preferred decoder upmixing scheme. In the illustrated case, the transmitted left channel is kept as the base channel for the left output channel. In order to derive the base channel for the left rear output channel, a linear combination between the left (l) and the right (r) transmitted channel, i.e., $l+\alpha r$, is determined. The weighting factor $\alpha$ is determined such that the cross-correlation between l and $l+\alpha r$ is equal to the transmitted desired value $CC_1$ for the left side and $CC_r$ for the right side or generally the coherence measure k.

The calculation of the appropriate α value is described in FIG. 2F. In particular, a normalized cross-correlation of two signals 1 and r is defined as shown in the equation in the block of FIG. 2E.

Given two transmitted signals 1 and r, the weighting factor α has to be determined such that the normalized cross-correlation of the signal 1 and l+αr is equal to a desired value k, i.e., the coherence measure. This measure is defined between −1 and +1.

Using the definition of the cross-correlation for the two channels, one obtains the equation given in FIG. 2F for the value k. By using several abbreviations which are given in the bottom of FIG. 2F, the condition for k can be rewritten as a quadratic equation, the solution of which gives the weighting factor α.

It can be shown that the equation always has real-valued solutions, i.e., that the discriminant is guaranteed to be non-negative.

Depending on the basic cross-correlation of the signal 1 and r, and on the desired cross-correlation k, one of both delivered solutions may in fact lead to the negative of the desired cross-correlation value and its, therefore, discarded for all further calculation.

After calculating the base channel signal as a linear combination of the 1 signal and the r signal, the resulting signal is normalized (re-scaled) to the original signal energy of the transmitted l or r channel signal.

Similarly, the base channel signal for the right output channel can be derived by swapping the role of the left and right channels, i.e., considering the cross-correlation between r and r+α1.

In practice, it is preferred to smooth the results of the calculation process for the α value over time and frequency in order to obtain maximum signal quality. Also front/back correlation measurements other than left/left rear and right/right rear can be used to further maximize signal quality.

Subsequently, a step-by-step description of the functionality performed by the multi-channel reconstructor 32 from FIG. 2A will be given, referring to FIG. 2G.

Preferably, a weighting factor α is calculated (200) based on a dynamic coherence measure provided from an encoder to a decoder or based on a static provision of a coherence measure as described in connection with FIG. 15A and FIG. 15B. Then, the weighting factor is smoothed over time and/or frequency (step 202) to obtain a smoothed weighting factor $\alpha_s$. Then, a base channel b is calculated to be for example $l+\alpha_s r$ (step 204). The base channel b is then used, together with other base channels, to calculate raw output signals.

As it becomes clear from box 206, the level representation ICLD as well as the delay representation ICTD are required for calculating raw output signals. Then, the raw output signals are scaled to have the same energy as a sum of the individual energies of the left and right input channels. Stated in other words, the raw output signals are scaled by means of a scaling factor such that a sum of the individual energies of the scaled raw output signals is the same as the sum of the individual energies of the transmitted left and right input channels.

Alternatively, one could also calculated the sum of the left and right transmitted channels and to use the energy of the resulting signal. Additionally, one could also calculate a sum signal by sample wise summing the raw output signals and to use the energy of the resulting signal for scaling purposes.

Then, at an output of box 208, the reconstructed output channels are obtained, which are unique in that none of the reconstructed output channels is fully coherent to another of the reconstructed output channels such that a maximum quality of the reproduced output signal is obtained.

To summarize, the inventive concept is advantageous in that an arbitrary number of transmitted channels (M) and an arbitrary number of output channels (N) can be used.

Additionally, the conversion between the transmitted channels and the base channels for the output channels is done via preferably dynamic upmixing.

In an important embodiment, upmixing consists of a multiplication by an upmixing matrix, i.e., forming linear combinations of the transmitted channels, wherein front channels are preferably synthesized by using the corresponding transmitted base channels as base channels, while the rear channels consist of linear combination of the transmitted channels, the degree of a linear combination depending on a coherence measure.

Additionally, this upmixing process is preferably performed signal adaptive in a time-varying fashion. Specifically, the upmixing process preferably depends on a side information transmitted from a BCC encoder such as interchannel coherence cues for a front/rear coherence.

Given the base channel for each output channel, a processing similar to a regular binaural cue coding is applied to synthesize spatial cues, i.e., applying scalings and delays in subbands and applying techniques to reduce coherence between channels, wherein ICC cues are additionally, or alternatively, used for constructing respective base channels to obtain optimal reproduction of front/rear coherence.

Figure 3A:
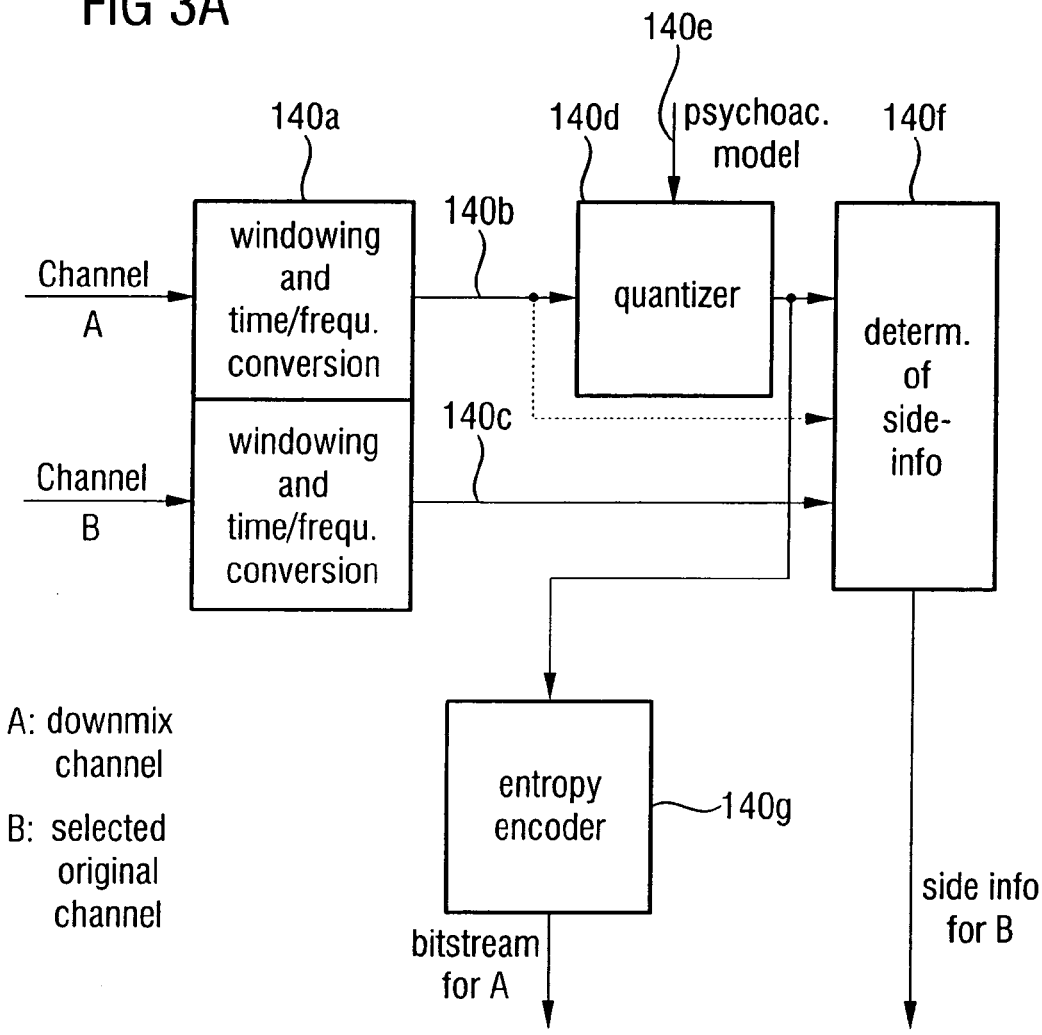
FIG. 3A is a block diagram for a preferred implementation of the means for calculating to obtain frequency selective channel side information.

FIG. 3A shows an embodiment of the inventive calculator 14 for calculating the channel side information, which an audio encoder on the one hand and the channel side information calculator on the other hand operate on the same spectral representation of multi-channel signal. FIG. 1, however, shows the other alternative, in which the audio encoder on the one hand and the channel side information calculator on the other hand operate on different spectral representations of the multi-channel signal. When computing resources are not as important as audio quality, the FIG. 1A alternative is preferred, since filterbanks individually optimized for audio encoding and side information calculation can be used. When, however, computing resources are an issue, the FIG. 3A alternative is preferred, since this alternative requires less computing power because of a shared utilization of elements.

The device shown in FIG. 3A is operative for receiving two channels A, B. The device shown in FIG. 3A is operative to calculate a side information for channel B such that using this channel side information for the selected original channel B, a reconstructed version of channel B can be calculated from the channel signal A. Additionally, the device shown in FIG. 3A is operative to form frequency domain channel side information, such as parameters for weighting (by multiplying or time processing as in BCC coding e. g.) spectral values or subband samples. To this end, the inventive calculator includes windowing and time/frequency conversion means 140*a* to obtain a frequency representation of channel A at an output 140*b* or a frequency domain representation of channel B at an output 140*c*.

In the preferred embodiment, the side information determination (by means of the side information determination means 140*f*) is performed using quantized spectral values. Then, a quantizer 140*d* is also present which preferably is controlled using a psychoacoustic model having a psychoacoustic model control input 140*e*. Nevertheless, a quantizer is not required, when the side information determination means 140*c* uses a non-quantized representation of the channel A for determining the channel side information for channel B.

In case the channel side information for channel 2 are calculated by means of a frequency domain representation of the channel A and the frequency domain representation of the channel B, the windowing and time/frequency conversion means 140*a* can be the same as used in a filterbank-based audio encoder. In this case, when AAC (ISO/IEC 13818-3) is considered, means 140*a* is implemented as an MDCT filter bank (MOCT=modified discrete cosine transform) with 50% overlap-and-add functionality.

In such a case, the quantizer 140*d* is an iterative quantizer such as used when mp3 or AAC encoded audio signals are generated. The frequency domain representation of channel A, which is preferably already quantized can then be directly used for entropy encoding using an entropy encoder 140*g*, which may be a Huffman based encoder or an entropy encoder implementing arithmetic encoding.

When compared to FIG. 1, the output of the device in FIG. 3A is the side information such as $l_i$ for one original channel (corresponding to the side information for R at the output of device 140*f*). The entropy encoded bitstream for channel A corresponds to e. g. the encoded left downmix channel Lc' at the output of block 16 in FIG. 1. From FIG. 3A it becomes clear that element 14 (FIG. 1), i.e., the calculator for calculating the channel side information and the audio encoder 16 (FIG. 1) can be implemented as separate means or can be implemented as a shared version such that both devices share several elements such as the MDCT filter bank 140*a*, the quantizer 140*e* and the entropy encoder 140*g*. Naturally, in case one needs a different transform etc. for determining the channel side information, then the encoder 16 and the calculator 14 (FIG. 1) will be implemented in different devices such that both elements do not share the filter bank etc.

Figure 3B:
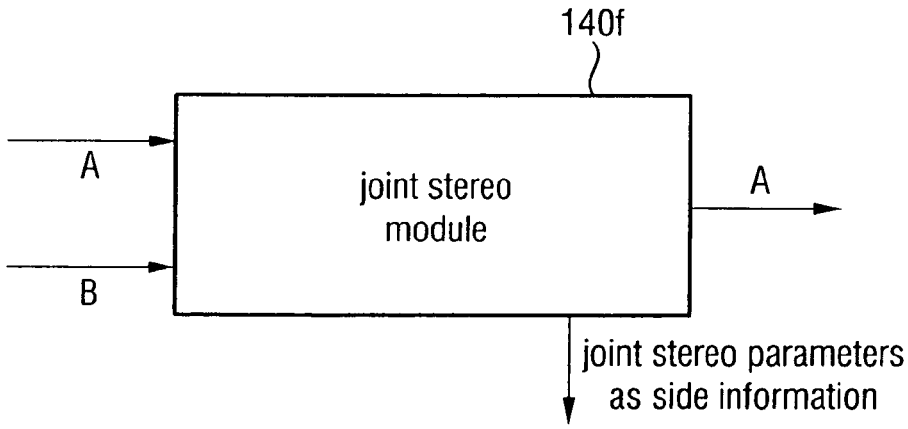
FIG. 3B is a preferred embodiment of a calculator implementing joint stereo processing such as intensity coding or binaural cue coding.

Generally, the actual determinator for calculating the side information (or generally stated the calculator 14) may be implemented as a join stereo module as shown in FIG. 3B, which operates in accordance with any or the joint stereo techniques such as intensity stereo coding or binaural cue coding.

In contrast to such prior art intensity stereo encoders, the inventive determination means 140*f* does not have to calculate the combined channel. The "combined channel" or carrier channel, as one can say, already exists and is the left compatible downmix channel Lc or the right compatible downmix channel Rc or a combined version of these downmix channels such as Lc+Rc. Therefore, the inventive device 140*f* only has to calculate the scaling information for scaling the respective downmix channel such that the energy/time envelope of the respective selected original channel is obtained, when the downmix channel is weighted using the scaling information or, as one can say, the intensity directional information.

Therefore, the joint stereo module 140*f* in FIG. 3B is illustrated such that it receives, as an input, the "combined" channel A, which is the first or second downmix channel or a combination of the downmix channels, and the original selected channel. This module, naturally, outputs the "combined" channel A and the joint stereo parameters as channel side information such that, using the combined channel A and the joint stereo parameters, an approximation of the original selected channel B can be calculated.

Alternatively, the joint stereo module 140*f* can be implemented for performing binaural cue coding.

In the case of BCC, the joint stereo module 140*f* is operative to output the channel side information such that the channel side information are quantized and encoded ICLD or ICTD parameters, wherein the selected original channel serves as the actual to be processed channel, while the respective downmix channel used for calculating the side information, such as the first, the second or a combination of the first and second downmix channels is used as the reference channel in the sense of the BCC coding/decoding technique.

Referring to FIG. 4, a simple energy-directed implementation of element 140*f* is given. This device includes a frequency band selector 44 selecting a frequency band from channel A and a corresponding frequency band of channel B. Then, in both frequency bands, an energy is calculated by means of an energy calculator 42 for each branch. The detailed implementation of the energy calculator 42 will depend on whether the output signal from block 40 is a subband signal or are frequency coefficients. In other implementations, where scale factors for scale factor bands are calculated, one can already use scale factors of the first and second channel A, B as energy values $E_A$ and $E_B$ or at least as estimates of the energy. In a gain factor calculating device 44, a gain factor $g_B$ for the selected frequency band is determined based on a certain rule such as the gain determining rule illustrated in block 44 in FIG. 4. Here, the gain factor $g_B$ can directly be used for weighting time domain samples or frequency coefficients such as will be described later in FIG. 5. To this end, the gain factor $g_B$, which is valid for the selected frequency band is used as the channel side information for channel B as the selected original channel. This selected original channel B will not be transmitted to decoder but will be represented by the parametric channel side information as calculated by the calculator 14 in FIG. 1.

It is to be noted here that it is not necessary to transmit gain values as channel side information. It is also sufficient to transmit frequency dependent values related to the absolute energy of the selected original channel. Then, the decoder has to calculate the actual energy of the downmix channel and the gain factor based on the downmix channel energy and the transmitted energy for channel B.

FIG. 5 shows a possible implementation of a decoder set up in connection with a transform-based perceptual audio encoder. Compared to FIG. 2, the functionalities of the entropy decoder and inverse quantizer 50 (FIG. 5) will be included in block 24 of FIG. 2. The functionality of the frequency/time converting elements 52*a*, 52*b* (FIG. 5) will, however, be implemented in item 36 of FIG. 2. Element 50 in FIG. 5 receives an encoded version of the first or the second downmix signal Lc' or Rc'. At the output of element 50, an at least partly decoded version of the first and the second downmix channel is present which is subsequently called channel A. Channel A is input into a frequency band selector 54 for selecting a certain frequency band from channel A. This selected frequency band is weighted using a multiplier 56. The multiplier 56 receives, for multiplying, a certain gain factor $g_B$, which is assigned to the selected frequency band selected by the frequency band selector 54, which corresponds to the frequency band selector 40 in FIG. 4 at the encoder side. At the input of the frequency time converter 52*a*, there exists, together with other bands, a frequency domain representation or channel A. At the output of multiplier 56 and, in particular, at the input of frequency/time conversion means 52*b* there will be a reconstructed frequency domain representation of channel B. Therefore, at the output of element 52*a*, there will be a time domain representation for channel A, while, at the output of element 52*b*, there will be a time domain representation of reconstructed channel B.

It is to be noted here that, depending on the certain implementation, the decoded downmix channel Lc or Rc is not played back in a multi-channel enhanced decoder. In such a multi-channel enhanced decoder, the decoded downmix channels are only used for reconstructing the original channels. The decoded downmix channels are only replayed in lower scale stereo-only decoders.

Figure 9:
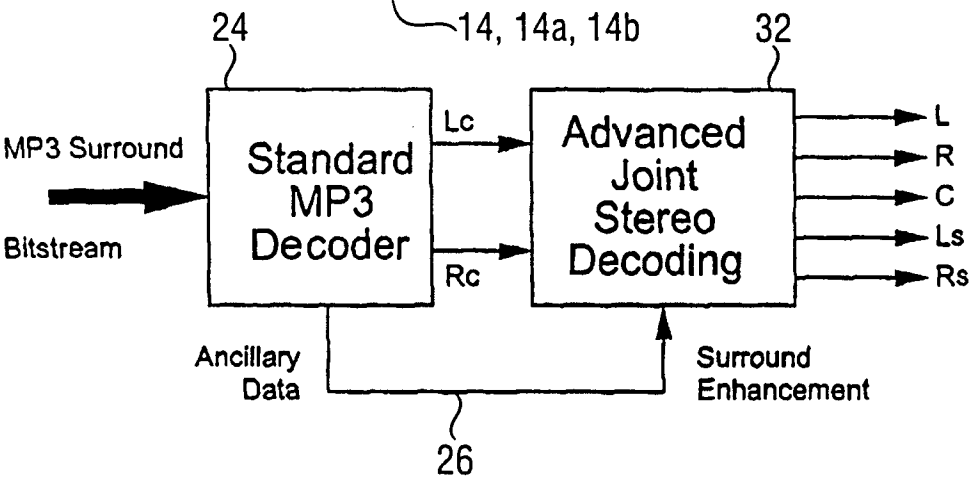
FIG. 9 illustrates another implementation of an inventive decoder.
Figure 10:
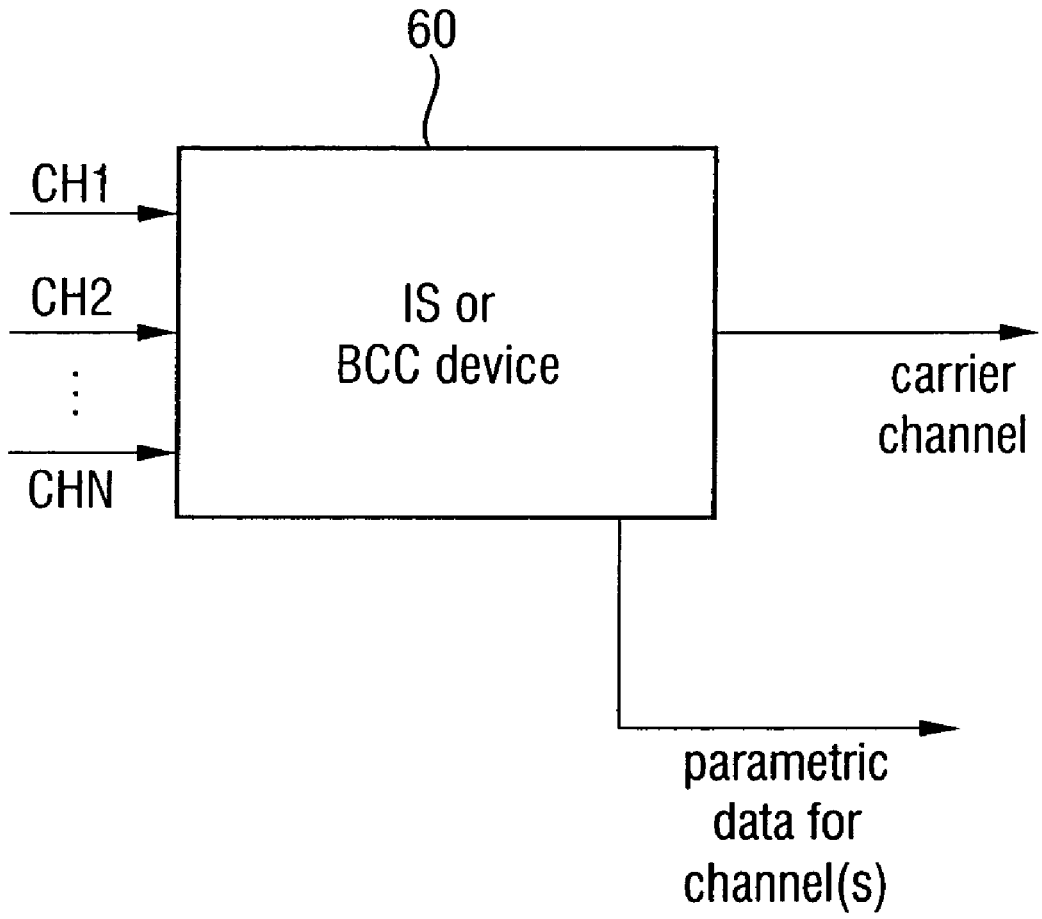
FIG 10 (Prior Art)
FIG. 10 illustrates a prior art joint stereo encoder.

To this end, reference is made to FIG. 9, which shows the preferred implementation of the present invention in a surround/mp3 environment. An mp3 enhanced surround bitstream is input into a standard mp3 decoder 24, which outputs decoded versions of the original downmix channels. These downmix channels can then be directly replayed by means of a low level decoder. Alternatively, these two channels are input into the advanced joint stereo decoding device 32 which also receives the multi-channel extension data, which are preferably input into the ancillary data field in a mp3 compliant bitstream.

Subsequently, reference is made to FIG. 7 showing the grouping of the selected original channel and the respective downmix channel or combined downmix channel. In this regard, the right column of the table in FIG. 7 corresponds to channel A in FIGS. 3A, 3B, 4 and 5, while the column in the middle corresponds to channel B in these figures. In the left column in FIG. 7, the respective channel side information is explicitly stated. In accordance with the FIG. 7 table, the channel side information $l_i$ for the original left channel L is calculated using the left downmix channel Lc. The left surround channel side information $ls_i$ is determined by means of the original selected left surround channel Ls and the left downmix channel Lc is the carrier. The right channel side information $r_i$ for the original right channel R are determined using the right downmix channel Rc. Additionally, the channel side information for the right surround channel Rs are determined using the right downmix channel Rc as the carrier. Finally, the channel side information $c_i$ for the center channel C are determined using the combined downmix channel, which is obtained by means of a combination of the first and the second downmix channel, which can be easily calculated in both an encoder and a decoder and which does not require any extra bits for transmission.

Naturally, one could also calculate the channel side information for the left channel e. g. based on a combined downmix channel or even a downmix channel, which is obtained by a weighted addition of the first and second downmix channels such as 0.7 Lc and 0.3 Rc, as long as the weighting parameters are known to a decoder or transmitted accordingly. For most applications, however, it will be preferred to only derive channel side information for the center channel from the combined downmix channel, i.e., from a combination of the first and second downmix channels.

To show the bit saving potential of the present invention, the following typical example is given. In case of a five channel audio signal, a normal encoder needs a bit rate of 64 kbit/s for each channel amounting to an overall bit rate of 320 kbit/s for the five channel signal. The left and right stereo signals require a bit rate of 128 kbit/s.

Channels side information for one channel are between 1.5 and 2 kbit/s. Thus, even in a case, in which channel side information for each of the five channels are transmitted, this additional data add up to only 7.5 to 10 kbit/s. Thus, the inventive concept allows transmission of a five channel audio signal using a bit rate of 138 kbit/s (compared to 320 (!) kbit/s) with good quality, since the decoder does not use the problematic dematrixing operation. Probably even more important is the fact that the inventive concept is fully backward compatible, since each of the existing mp3 players is able to replay the first downmix channel and the second downmix channel to produce a conventional stereo output.

Depending on the application environment, the inventive methods for constructing or generating can be implemented in hardware or in software. The implementation can be a digital storage medium such as a disk or a CD having electronically readable control signals, which can cooperate with a programmable computer system such that the inventive methods are carried out. Generally stated, the invention therefore, also relates to a computer program product having a program code stored on a machine-readable carrier, the program code being adapted for performing the inventive methods, when the computer program product runs on a computer. In other words, the invention, therefore, also relates to a computer program having a program code for performing the methods, when the computer program runs on a computer.

What is claimed is:

1. Apparatus for constructing a multi-channel output signal using an input signal and parametric side information, the input signal including a first input channel and a second input channel derived from an original multi-channel signal, the original multi-channel signal having a plurality of channels, the plurality of channels including at least two original channels, which are defined as being located at one side of an assumed listener position, wherein a first original channel is a first one of the at least two original channels, and wherein a second original channel is a second one of the at least two original channels, and the parametric side information describing interrelations betweens original channels of the multi-channel original signal, comprising:

means for determining a first base channel by selecting one of the first and the second input channels or a combination of the first and the second input channels, and for determining a second base channel by selecting the other of the first and the second input channels or a different combination of the first and the second input channels, such that the second base channel is different from the first base channel; and means for synthesizing a first output channel using the parametric side information and the first base channel to obtain a first synthesized output channel which is a reproduced version of the first original channel which is located at the one side of the assumed listener position, and for synthesizing a second output channel using the parametric side information and the second base channel, the second output channel being a reproduced version of the second original channel which is located at the same side of the assumed listener position.

2. Apparatus in accordance with claim 1, further comprising:

means for providing a coherence measure, the coherence measure depending on a coherence between a first original channel and a second original channel, the first and the second original channels being included in an original multi-channel signal;

in which the means for determining is operative to determine the first and the second base channels different from each other based on the coherence measure.

3. Apparatus in accordance with claim 1, in which the at least two original channels include a left original channel and a left surround original channel or a right original channel and a right surround original channel.

4. Apparatus in accordance with claim 1, in which a combination of the first and the second input channels determined to be the second base channel is such that one of the two input channels contributes to the second base channel more than the other input channel.

5. Apparatus in accordance with claim 2, in which the coherence measure is time-varying such that the means for determining is operative to determine the second base channel as a combination of the first input channel and the second input channel, the combination being variable over time.

6. Apparatus in accordance with claim 1, in which parametric side information includes the coherence measure, the coherence measure being determined using the first original channel and the second original channel, wherein the means for providing is operative to extract the coherence measure from the parametric side information.

7. Apparatus in accordance with claim 6, in which the input signal has a sequence of frames and the-parametric side information includes a sequence of parameters including the coherence measure, the parameters being associated with the frames.

8. Apparatus in accordance with claim 1, in which the original signal further includes a center channel, and in which the means for determining is further operative to calculate a third base channel using the first input channel and the second input channel in equal portions.

9. Apparatus in accordance with claim 1, in which the parametric side information are frequency dependent and the means for synthesizing are operative to perform a frequency-dependent synthesis.

10. Apparatus in accordance with claim 1, in which the parametric side information include binaural cue coding (ECC) parameters including inter-channel level difference parameters and inter-channel time delay parameters, and in which the means for synthesizing is operative to perform a BOG synthesis using a base channel determined by the means for determining when synthesizing an output channel.

11. Apparatus in accordance with claim 2, in which the means for determining is operative to determine the first base channel as one of the first and second input channels and to determine the second base channel as a weighted combination of the first and the second input channels, a weighting factor depending on the coherence measure.

12. Apparatus in accordance with claim 11, in which the weighting factor is determined as follows:

$$\alpha_{1:2} = \frac{-B \pm \sqrt{B^2 - 4AC}}{2A},$$

wherein α is the weighting factor, and wherein A, B, C are determined as follows, $$A=C^2-K^2IR\ B=2LC(1-K^2)C=L^2(1-K^2)$$

wherein L, R, C are determined as follows, $$L=\Sigma l^2R=\Sigma r^2C=\Sigma l\cdot r$$

and wherein k is the coherence measure, and wherein 1 is the first input channel and r is the second input channel.

13. Apparatus in accordance with claim 11, in which the coherence measure is given for a frequency band, and in which the means for determining is operative to determine the second base channel for the frequency band.

14. Apparatus in accordance with claim 11, in which the coherence measure is determined as follows:

$$cc(x, y) = \frac{\sum x \cdot y}{\sqrt{\sum x^2} \cdot \sqrt{\sum y^2}},$$

wherein cc(x,y) is the coherence measure between two original channels x, y, wherein $x_i$ is a sample at a time instance i of the first original channel, and wherein $y_i$ is a sample at a time instance i of the second original channel.

15. Apparatus in accordance with claim 1, in which the means for determining is operative to scale the output channels using power measures derived from the original channels, the power measures being transmitted within the parametric side information.

16. Apparatus in accordance with claim 11, in which the means for determining is operative to smooth the weighting factor over time and/or frequency.

17. Apparatus in accordance with claim 1, in which the parametric side information include level information representing an energy distribution of the original channels in the original signal, and wherein the means for synthesizing is operative to scale the output channels such that a sum of the energies of the output channels is equal to a sum of the energies of the first input channel and the second input channel.

18. Apparatus in accordance with claim 17, in which the means for synthesizing is operative to calculate raw output channels based on determined base channels and the level information and to scale the raw output channels such that a total energy of scaled raw output channels is equal to a total energy of the first and the second input channels.

19. Apparatus in accordance with claim 1, in which the input signal includes a left channel and a right channel, and the original channel includes a front left channel, a left surround channel, a front right channel and a right surround channel, and in which the means for determining is operative to determine the left channel as the base channel for a synthesis of the front left channel, the right channel is the base channel for a synthesis of the front right channel, a combination of the left channel and the right channel as the base channel for the left surround channel or the right surround channel.

20. Apparatus in accordance with claim 1, in which the input signal includes a left channel and a right channel and the original signal includes a front left channel, a left surround channel, a front right channel and a right surround channel, and in which the means for determining is operative to determine the left channel as the base channel for a synthesis of the front left channel, the right channel as the base channel for a synthesis of the right surround channel, and a combination of the first and the second input channels as the base channel for a synthesis of the front right channel or the left surround channel.

21. Method of constructing a multi-channel output signal using an input signal and parametric side information, the input signal including a first input channel and a second input channel derived from an original multi-channel signal, the original multi-channel signal having a plurality of channels, the plurality of channels including at least two original channels, which are defined as being located at one side of an assumed listener position, wherein a first original channel is a first one of the at least two original channels, and wherein a second original channel is a second one of the at least two original channels, and the parametric side information describing interrelations betweens original channels of the multi-channel original signal, comprising: determining a first base channel by selecting one of the first and the second input channels or a combination of the first and the second input channels, and determining a second base channel by selecting the other of the first and the second input channels or a different combination of the first and the second input channels, such that the second base channel is different from the first base channel; and synthesizing a first output channel using the parametric side information and the first base channel to obtain a first synthesized output channel which is a reproduced version of the first original channel which is located at the one side of the assumed listener position, and synthesizing a second output channel using the parametric side information and the second base channel, the second output channel being a reproduced version of the second original channel which is located at the same side of the assumed listener position.

22. Apparatus for generating a downmix signal from a multi-channel original signal, the downmix signal having a number of channels being smaller than a number of original channels, comprising:

means for calculating a first downmix channel and a second downmix channel using a downmix rule;

means for calculating parametric level information representing an energy distribution among the channels in the multi-channel original signal;

means for determining a coherence measure between two original channels, the two original channels being located at one side of an assumed listener position; and means for forming an output signal using the first and the second downmix channels, the parametric level information and only at least one coherence measure between two original channels located at the one side or a value derived from the at least one coherence measure, but not using any coherence measure between channels located at different sides of the assumed listener position.

23. Apparatus in accordance with claim 22, further comprising means for determining time delay information between two original channels located at one side of the assumed listener position; and wherein the means for forming is operative to only include time level information between two original channels located at one side of the assumed listener position but not time level information between two original channels located at different sides of the assumed listener position.

24. Method of generating a downmix signal from a multi-channel original signal, the downmix signal having a number of channels being smaller than a number of original channels, comprising: calculating a first downmix channel and a second downmix channel using a downmix rule; calculating parametric level information representing an energy distribution among the channels in the multi-channel original signal; determining a coherence measure between two original channels, the two original channels being located at one side of an assumed listener position; and forming an output signal using the first and the second downmix channels, the parametric level information and only at least one coherence measure between two original channels located at the one side or a value derived from the at least one coherence measure, but not using any coherence measure between channels located at different sides of the assumed listener position.

25. A computer-readable medium having a computer-executable instruction for performing a method of constructing a multi-channel output signal using an input signal and parametric side information, the input signal including a first input channel and a second input channel derived from an original multi-channel signal, the original multi-channel signal having a plurality of channels, the plurality of channels including at least two original channels, which are defined as being located at one side of an assumed listener position, wherein a first original channel is a first one of the at least two original channels, and wherein a second original channel is a second one of the at least two original channels, and the parametric side information describing interrelations betweens original channels of the multi-channel original signal, comprising: determining a first base channel by selecting one of the first and the second input channels or a combination of the first and the second input channels, and determining a second base channel by selecting the other of the first and the second input channels or a different combination of the first and the second input channels, such that the second base channel is different from the first base channel; and synthesizing a first output channel using the parametric side information and the first base channel to obtain a first synthesized output channel which is a reproduced version of the first original channel which is located at the one side of the assumed listener position, and synthesizing a second output channel using the parametric side information and the second base channel, the second output channel being a reproduced version of the second original channel which is located at the same side of the assumed listener position.

26. A computer-readable medium having a computer-executable instruction for performing a method of generating a downmix signal from a multi-channel original signal, the downmix signal having a number of channels being smaller than a number of original channels, comprising: calculating a first downmix channel and a second downmix channel using a downmix rule; calculating parametric level information representing an energy distribution among the channels in the multi-channel original signal; determining a coherence measure between two original channels, the two original channels being located at one side of an assumed listener position; and forming an output signal using the first and the second downmix channels, the parametric level information and only at least one coherence measure between two original channels located at the one side or a value derived from the at least one coherence measure, but not using any coherence measure between channels located at different sides of the assumed listener position.

* * * * *